US009366245B2

(12) United States Patent
Ono et al.

(10) Patent No.: US 9,366,245 B2
(45) Date of Patent: Jun. 14, 2016

(54) TUBE PUMP AND TUBE STABILIZER

(75) Inventors: Kenichi Ono, Tokyo (JP); Sousuke Akiyama, Tokyo (JP)

(73) Assignee: WELCO CO., LTD., Tokyo (JP)

( * ) Notice: Subject to any disclaimer, the term of this patent is extended or adjusted under 35 U.S.C. 154(b) by 513 days.

(21) Appl. No.: 13/472,577

(22) Filed: May 16, 2012

(65) Prior Publication Data

US 2012/0294743 A1 Nov. 22, 2012

Related U.S. Application Data

(63) Continuation of application No. 13/470,134, filed on May 11, 2012, now Pat. No. 9,175,678, which is a continuation-in-part of application No. PCT/JP2010/070143, filed on Nov. 11, 2010.

(30) Foreign Application Priority Data

Nov. 12, 2009 (JP) ..... 2009-258648
Jun. 25, 2010 (JP) ..... 2010-144713

(51) Int. Cl.
*F04B 43/12* (2006.01)

(52) U.S. Cl.
CPC ..... *F04B 43/1284* (2013.01); *F04B 43/1253* (2013.01); *F04B 43/1261* (2013.01); *F04B 43/1276* (2013.01)

(58) Field of Classification Search
CPC ..... F04B 43/1253; F04B 43/1276; F04B 43/1284; F04B 45/08
USPC ..... 417/474, 475, 476, 477.1, 477.2, 477.3, 417/477.6, 477.9
See application file for complete search history.

(56) References Cited

U.S. PATENT DOCUMENTS 3,724,974 A * 4/1973 Molimard ..... 417/477.6
4,518,327 A * 5/1985 Hackman ..... 417/477.3
4,573,887 A * 3/1986 Smith ..... 417/477.1
4,702,679 A 10/1987 Malbec
4,720,249 A 1/1988 Krebs et al.
4,792,295 A 12/1988 Joyce, Sr.

(Continued)

FOREIGN PATENT DOCUMENTS

CN 1397735 2/2003
CN 101164708 4/2008

(Continued)

OTHER PUBLICATIONS

International Preliminary Report on Patentability of PCT/JP2010/070143 dated Jun. 12, 2012.

(Continued)

*Primary Examiner* — Justin Jonaitis
*Assistant Examiner* — Charles Nichols
(74) *Attorney, Agent, or Firm* — McCarter & English, LLP

(57) ABSTRACT

A tube pump comprises a rotor configured to have a roller and to hold the roller to be able to make an orbital motion along the inner circumferential surface of the cap. The rotor includes a disk part which holds the roller on a base side, and a tube press member that engages with the disk part so that the tube does not move to the base side with respect to the disk part, seals a gap formed with respect to the inner circumferential surface of the cap, and is capable of rotating along an outer circumferential part of the disk part is provided at the outer circumferential part of the disk part.

2 Claims, 17 Drawing Sheets

(56) References Cited

U.S. PATENT DOCUMENTS

| | | | | |
|---|---|---|---|---|
| 5,044,902 | A | 9/1991 | Malbec | |
| 5,356,267 | A | 10/1994 | Fulmer | |
| 5,429,486 | A | 7/1995 | Schock et al. | |
| 5,741,125 | A | 4/1998 | Neftel et al. | |
| 5,746,585 | A | 5/1998 | McDunn et al. | |
| 5,779,460 | A | 7/1998 | Marz | |
| 6,102,678 | A | 8/2000 | Peclat | |
| 6,419,466 | B1 * | 7/2002 | Lowe et al. | 417/477.11 |
| 6,918,748 | B2 | 7/2005 | Miyazawa | |
| 7,918,657 | B2 | 4/2011 | Bobo et al. | |
| 8,182,241 | B2 | 5/2012 | Fulmer | |
| 2004/0179964 | A1 * | 9/2004 | O'Mahony et al. | 417/477.2 |
| 2005/0069436 | A1 | 3/2005 | Shibasaki | |
| 2005/0127104 | A1 * | 6/2005 | Tu | 222/209 |
| 2005/0254978 | A1 | 11/2005 | Huber et al. | |
| 2007/0020130 | A1 | 1/2007 | Malbec et al. | |
| 2007/0031272 | A1 * | 2/2007 | Ramirez et al. | 417/477.1 |
| 2008/0092932 | A1 | 4/2008 | Tam | |
| 2008/0095645 | A1 | 4/2008 | Tam | |
| 2008/0304982 | A1 * | 12/2008 | Miyazaki et al. | 417/412 |

FOREIGN PATENT DOCUMENTS

| | | |
|---|---|---|
| CN | 101415946 | 4/2009 |
| JP | HEI 6-154310 | 6/1994 |
| JP | 2007509267 | 4/2007 |
| JP | 2007198150 | 8/2007 |

OTHER PUBLICATIONS

Chinese Office Action issue in Application No. 201080051251.2 on Jun. 26, 2014.

U.S. Office Action issued in U.S. Appl. No. 13/470,134 on Jan. 14, 2015.

U.S. Office Action issued in U.S. Appl. No. 13/472,593 on Feb. 6, 2015.

U.S. Office Action issued in U.S. Appl. No. 13/470,134 on Sep. 25, 2014.

U.S. Office Action issued in U.S. Appl. No. 13/472,593 on Oct. 20, 2014.

TW Office Action issued in Application No. 099138957 on Apr. 20, 2015.

U.S. Office Action issued in U.S. Appl. No. 13/472,593 on Jan. 7, 2016.

U.S. Office Action issued in U.S. Appl. No. 13/472,593 on Aug. 7, 2015.

* cited by examiner

TUBE PUMP AND TUBE STABILIZER

CROSS-REFERENCE TO RELATED APPLICATIONS

This application is a Continuation application of U.S. Ser. No. 13/470,134 filed May 11, 2012, which is a Continuation-in-Part of International Application No. PCT/JP2010/070143 filed Nov. 11, 2010, which claims priority from Japanese Patent Application Nos. 2009-258648, filed Nov. 12, 2009 and 2010-144713, filed Jun. 25, 2010. The entire disclosure of the prior applications is hereby incorporated herein by reference herein its entirety.

TECHNICAL FIELD

The present invention relates a tube pump configured to move a roller pressing a tube along the tube and thereby to transport liquid in the tube by a peristaltic motion of the tube.

BACKGROUND

As an apparatus for transporting a relatively small amount of liquid, a tube pump configured to move a roller pressing a tube along the tube and thereby to transport liquid in the tube by a peristaltic motion of the tube has been widely used, as described, for example, in U.S. Pat. No. 5,356,267 (hereafter, referred to as patent document #1).

FIG. 10 is a side cross section of a conventional tube pump. As shown in FIG. 10, a tube pump 201 includes a drive motor 210, a gear box 220 and a pump main body 300. A rotation shaft 211 of the drive motor 210 is connected to the gear box 220. The gear box 220 transmits a rotational motion of the drive shaft 21110 an output shaft 221 of the gear box 220 while decelerating the rotational motion of the rotation shaft 211.

The pump main body 300 includes a cap 310, a rotor 320 and a base 340. The cap 310 includes a cylindrical inner surface 311. A tube 360 of the tube pump 201 is arranged along the inner surface 311 of the cap 310.

The rotor 320 includes a rotor main body 321, a roller 322 and a roller pressure member 323. The rotor main body 321 includes a circular plate 321*g* and a main support shaft 321*f* extending from the central part of the circular plate 321*g* to the cap 310. The roller pressure member 323 is a member having a shape of a circular plate and is arranged on the cap 310 side with respect to the rotor main body 321. The roller pressure member 323 holds the roller 322 between the rotor main body and the roller pressure member 323. The rotor 321 is supported to be rotatable with respect to the cap 310, and is configured such that the roller 322 rotates along the inner surface 311 of the cap 310 by rotating the rotor 320. When the rotor 320 rotates, the tube 360 is pressed between the roller 322 and the inner surface 311 of the cap 310 to produce a peristaltic motion and thereby the liquid in the tube 360 is transported.

The base 340 is fixed to the gear box 220 with a bolt (not shown). The cap 310 is detachably attachable to the base 340. When the cap 310 accommodating the tube 360 and the rotor 320 is attached to the base 340, the output shah of the gear box 220 engages with the rotor main body 321, and it becomes possible to rotate the rotor 320 by driving the drive motor 210.

In a tube pump in which liquid in a tube is transported by moving a roller, which presses a flexible tube to be a flat shape, along the tube, sometimes the tube is pulled in the moving direction of the roller by being pressed by the roller. If pulling-in of the tube occurs, the extra length of the upper side tube gradually decreases, and thereby it becomes necessary to periodically conduct a re-stretching work for the tube. Therefore, a tube fixing member for fixing the upstream part and/or the downstream part of the tube to the tube pump main body is used. Japanese Patent Provisional Publication No. 2007-198150A (hereafter, referred to as patent document #2) discloses a tube pump which uses a tube fixing member (a holder 4*d*) formed by bending a wire in a gate shape. In the tube pump disclosed in patent document #2, two circular holes are formed in a front surface of a main body housing which accommodates a drive motor, and a tube is fixed between the tube fixing member and the main body housing by inserting the both ends of the tube fixing member into the two circular holes. Regarding the tube fixing member of the patent document #2, the number components is small (configured by a single component), and the fixing/releasing of the tube can be achieved by insertion or drawing (i.e., a single step) of the tube fixing member. Therefore, the tube fixing member is excellent in regard to the part cost and the workability.

SUMMARY

In the conventional tube pump shown in FIG. 10, a projection 341 protruding to the cap 310 side is formed on the base 340. The projection 341 is provided to seal a space between the roller 322 and the inner surface 311 of the cap 310, so that the tube 360 does not drop off the roller 322 even when the tube 360 moves to the base 340 side.

As described above, in the conventional tube pump, the projection 341 which is a mechanism for preventing dropping-off of the tube 360 is provided on the base 340. Since the projection 341 is inserted into the space between the roller 322 and the inner surface 311 of the cap 310, it is required to secure a large space between the roller 322 and the inner surface 311 of the cap 310. That is, in order to suppress the dropping-off of the tube in the conventional tube pump, the size of the tube pump inevitably increases, and it is difficult to downsize the tube pump.

Furthermore, in the conventional tube pump 201, there is a possibility that the tube 360 contacts the projection 341 and thereby a force for drawing the cap 310 from the base 340 occurs, and the cap 310, particularly a nail 314 for engaging the cap 310 with the base 340, is damaged due to the force.

The present invention is made to solve the above described problem. That is, the first object of the invention is to provide a compact tube pump in which damage of a cap is hard to occur.

Furthermore, the conventional pump 201 shown in FIG. 10 is configured such that a high degree of torque applies to the main support shaft 321*f*. Therefore, the main support shaft 321*f* is formed to have a large diameter. Therefore, in order to decrease the size of the tube pump 201, the diameter of the roller 322 is inevitably decreased. Id the diameter of the roller 322 is small, the contact surface between the roller 322 and the tube 360 also decreases. As a result, the load applies to the tube in a concentrated manner, and fatigue of the tune occurs in a relatively short time period.

The present invention is made to solve the above described problem. That is, the second object of the present invention is to provide a compact tube pump in which a large diameter of a roller pressing a tube can be secured.

Furthermore, the conventional tube pump 201 shown in FIG. 10 is configured such that the output shaft 221 of the gear box 220 can be fixed to an engagement hole 321*e* formed in the circular plate 321*h* of the rotor main body 321. In order to transmit a high degree of torque from the output shaft 221 to the rotor main body 321, the cross sectional shape of each of the output shaft 221 and the engagement hole 321*e* is non-circular. Therefore, when the output shaft 221 of the gear box is attached to the rotor, positions of these members need to be registered. In order to conduct such registration effectively, it is preferable that the registration is conducted in a state where the gear box 220 is detached from the engagement hole 321*e* to some extent. That is, it is preferable that the size in the length direction of the output shaft 221 and the engagement hole 321*e* is sufficiently large. When the size of the tube pump can be set to be large, it is also possible to set the size in the length direction of the output shaft 221 and the engagement hole 321*e* to be large. However, in a compact tube pump, it is impossible to set the size in the length direction of the output shaft 221 and the engagement hole 321*e* to be large. Therefore, in order to fit the output shaft 221 into the engagement hole 321*e* in the tube pump 201 shown in FIG. 10, it is necessary to conduct the registration of the output shaft 221 and the rotor main body 321 in a state where the cap 310 is situated close to the base 340. Since such registration work is not easy, the conventional tube pump lakes a long lime for assembling.

The present invention is made to solve the above described problem. That is, the third object of the present invention is to provide a tube pump in which a drive unit including a drive motor and a gear box can be connected to a roller by a relatively easy work.

With regard to the tube pump described in the patent document #2, the following problem is considered. That is, in the conventional fixing manner disclosed in the patent document #2, the force for holding the tube with a tube fixing member (i.e., the deforming amount of the tube) fluctuates depending on the inserting amount of the both ends of the tube fixing member to circular holes. It is difficult to precisely control the inserting amount of the tube fixing member to the circular hole, and therefore a large degree of variations of the holding force of the tube by the conventional fixing member described in the patent document #2 cannot be avoided. Therefore, a problem frequently arises that the pulling-in of the tube occurs due to insufficient fixing of the tube by the tube fixing member, and decrease of the flowing amount and the deterioration and the damage of the tube occur due to excessive pressing of the tube.

To achieve the first object of the invention, a tube pump according to the invention includes a rotor configured to have a roller and to hold the roller to be able to make an orbital motion along the inner circumferential surface of the cap, and the rotor includes a disk part which holds the roller on a base side, and a tube press member that engages with the disk part so that the tube does not move to the base side with respect to the disk part, seals a gap formed with respect to the inner circumferential surface of the cap, and is capable of rotating along an outer circumferential part of the disk part is provided at the outer circumferential part of the disk part.

Since, according to the above described configuration, dropping-off of the tube is prevented by the tube press member attached to the rotor, there is no necessity to provide a mechanism for preventing dropping-off of the tube on the base. Therefore, a compact tube pump can be realized. When the tube contacts the tube press member, the tube press member stays still because of the frictional force acting between the tube and the tube press member. Therefore, even if the rotor rotates, the tube is not pulled by the tube press member, and therefore, the load acting on the tube and the tube press member becomes small. There is a possibility that, in a configuration where the dropping-off of the tube is suppressed by the rotor itself, the tube is pulled by the rotor when the tube contacts the rotor and thereby the tube is damaged. By contrast, according to the invention, the tube is not pulled, and the lifetime of the tube becomes long.

A step part may be formed on an outer circumferential surface of the disk part such that a diameter of the disk part is made larger on the base side, and the tube press member may be a ring-shaped member having an inner circumferential surface on which a step part engaging with the step part of the disk part is formed.

The rotor may include a roller presser member that holds the roller while sandwiching the roller between the roller presser member and the disk part. In this case, a rotor support shaft may be formed on the cap to extend toward the base, a main support shaft may be formed at a central part of the disk part to extend toward the roller presser member, and a bearing hole may be formed in each of the roller presser member and the main support shaft so as to enable the rotor to rotate around the rotor support shaft.

The rotor may include a roller presser member that holds the roller between the roller presser member and the disk part, a main support shaft may be formed at a central part of the disk part to extend toward the roller presser member so that a tip of the main support shaft contacts the roller presser member, and a rib may be formed between the disk part and the main support shaft.

An engagement part that engages with the roller presser member and transmits a rotational motion of the disk part to the roller presser member may be formed on the rib.

The engagement part of the rib may be a projection that protrudes toward the roller presser member. In this case, a hole is formed in the roller presser member to accommodate the projection.

A hole may be formed at a central part of the roller to extend along an axis direction, and a roller support shaft that extends toward the roller presser member and is accommodated in the hole of the roller may be formed on the disk part so as to rotatable support the roller.

The tube pump may further include a drive unit that is fixed to the base and rotates the rotor so that the roller makes the orbital motion, and a joint shaft that transmits a rotational motion of an output shaft of the drive unit to the rotor. In this case, the rotor may include a roller presser member that holds the roller between the roller presser member and the disk part, a main support shaft may be formed at a central part of the disk part such that the main support shaft extends toward the roller presser member and a tip of the main support shaft contacts the roller presser member, a positioning shaft part having a non-circular cross section may be formed on a rotor side end portion of the joint shaft, and an engagement shaft part that has a non-circular cross section and has a diameter larger than that of the positioning shaft part may be formed on a drive unit side portion of the joint shaft with respect to the positioning shaft part. A positioning hole that is capable of engaging with the positioning shaft part may be formed in the main support shaft, and an engagement hole that is capable of engaging with the engagement shaft part may be formed in the disk pail.

The positioning shall part may be formed such that a cross section radially extending from an center axis line of the joint shaft has a shape of a letter "Y".

The engagement shaft part may have a cross section having a triangular shape.

On a part of an outer circumferential surface of the cap, a nail may be formed to protrude outward in a radial direction, a recession in which the cap is accommodated may be formed on the base, and a nail may be formed on the recession of the base such that the nail of the base engages with the nail of the cap to prevent the cap from dropping off the base. In this case, the nail of the base contacts the outer circumferential surface of the cap, and the cap is reinforced by the nail of the case from an outside in the radial direction.

An engagement projection may be formed on one of the nail of the base and the outer circumferential surface of the cap with which the nail of the base contacts, and an engagement recession may be formed on the other of the nail of the base and the outer circumferential surface of the cap.

The engagement projection may be formed in a shape of a pin extending in an axis direction of the cap.

To achieve the above described second object, the tube pump according to the invention includes a rotor configured to have a roller and to hold the roller to be able to make an orbital motion along the inner circumferential surface of the cap. The rotor includes a disk part which holds the roller on a base side, and a roller presser member that holds the roller between the roller presser member and the disk part. A main support shaft is formed at a central part of the disk part such that the main support shaft extends toward the roller presser member and a tip of the main support shaft contacts the roller presser member, and a rib is formed between the disk part and the main support shaft.

According to the above described tube pump, since the main support shall is reinforced by the rib, it becomes possible to secure a large diameter for the roller while decreasing the diameter of the main support shaft even when the tube pump is formed to be compact.

To achieve the above described third object, the tube pump according to the invention includes a rotor configured to have a roller and to hold the roller to be able to make an orbital motion along the inner circumferential surface of the cap. The tube pump includes a base to which the cap is attached, a drive unit that is fixed to the base and rotates the rotor so that the roller makes the orbital motion, and a joint shaft that transmits a rotational motion of an output shaft of the drive unit to the rotor. The rotor includes a disk part which holds the roller on a disk side, and a roller presser member that holds the roller between the roller presser member and the disk part. A main support shaft is formed at a central part of the disk part such that the main support shaft extends toward the roller presser member and a tip of the main support shaft contacts the roller presser member, a positioning shaft part having a non-circular cross section is formed on a rotor side end portion of the joint shaft, an engagement shaft part that has a non-circular cross section and has a diameter larger than that of the positioning shaft pad is formed on a drive unit side portion of the joint shaft with respect to the positioning shaft part, a positioning hole that is capable of engaging with the positioning shaft part is formed in the main support shaft, and an engagement hole that is capable of engaging with the engagement shaft part is formed in the disk part.

According to the above described tube pump, the drive unit can be coupled to the rotor by simply moving the cap to the base in a state where the positioning shaft part of the joint shaft and the positioning hole formed in the inside of the main support shaft engage with each other. The engagement between the positioning shaft part and the positioning hole can be conducted in a state where the cap is away from the base. Therefore, according to the invention, the drive unit can be easily coupled to the rotor even when the tube pomp is formed to be compact.

In view of the above described circumstances, a tube fixing member according to an embodiment of the invention is provided. The tube fixing member according to an embodiment of the invention is a tube fixing member for fixing a flexible tube to a housing of a tube pump, wherein the tube pump transports liquid in the flexible tube arranged along a wall surface by continuously pressing and flattening a part of the flexible tube to cause elastic deformation through use of a roller moving along the wall surface. The tube fixing member includes a first holding part which sandwiches the flexible tube between the first holding part and the housing of the tube pump, and an engagement part that protrudes from the first holding part, engages with the housing of the tube pump, and presses the first holding part against the housing of the tube pump.

By using the tube fixing member having the above described configuration, it becomes possible to hold the tube by a constant appropriate holding force. Therefore, a problem that the tube is excessively deformed and is damaged or inversely pulling-in of the tube cannot be securely prevented due to the excessively weak holding force does not occur. Furthermore, since the attaching/detaching of the tube fixing member can be achieved by a one-touch operation, it becomes possible to effectively perform assembling and maintenance work for the tube pump.

A recessing part which contacts the flexible tube may be formed on the first holding part. The recessing part may be formed to be a recessed curved surface having a curvature substantially equal to a curvature of a side surface of the flexible tube.

By providing such a recessing part, precise positioning for the flexible tube can be realized. In particular, when the flexible tube is formed of a slender tube or of soft material, the lifetime of the flexible tube can be enhanced. When the recessing part is formed to be a recessed curved surface having a curvature substantially equal to a curvature of a side surface of the flexible tube, the holding force acting on the side surface of the flexible tube becomes uniform, and the stress concentration does not occur. Therefore, the lifetime of the flexible tube can be further enhanced.

It is preferable that the engagement part may be formed to protrude in a direction to which the recessing part points. At a tip portion of the engagement part in a protruding direction, a second engagement mechanism is formed to engage with a first engagement mechanism formed on the housing of the tube pump. For example, the first engagement mechanism and the second engagement mechanism are an engagement projection and an engagement nail, respectively, or are an engagement nail and an engagement projection, respectively.

With this configuration, it becomes possible to attach the tube fixing member to the housing with a strong force.

The recessing part may include a first recession which contacts a first end of the flexible tube, and a second recession which contacts a second end of the flexible tube. In this case, it is preferable that the engagement part protrudes from an intermediate position between positions of the first recession and the second recession.

By employing such a configuration where the both ends of the flexible tube is fixed by one tube fixing member, it becomes possible to considerably decrease the work man-hour for attaching the tube fixing member in addition to achieving reduction of the number of parts and downsizing.

It is preferable that the engagement part includes a first part protruding perpendicularly from a first surface of the first holding part, and a second part protruding, from a tip of the first part, in a frontward direction to which the recessing part points, and a most frontward surface of the first part is formed to have an offset to a back side with respect to a most frontward surface of the first holding part.

By thus arranging the most front surface of the first part to have an offset to the back side with respect to the most front surface of the first holding part, it becomes possible to securely engage the first part with an rear end of a support part (e.g., a flat plate part). As a result, the attaching work of the tube fixing member is made more efficient, and the tube can be stably held by the tube fixing member.

The tube fixing member may further include a second holding part which is arranged between the first holding part and the housing of the tube pump and which sandwiches the flexible tube between the second holding part and the first holding part.

By employing such a second holding part, it becomes possible to hold the flexible tube without causing the shearing force. Therefore, a problem that the tube buckles due to the shearing force can be prevented, particularly in the case where a slender tube or a tube formed of soft material is used. Furthermore, it becomes possible to arrange the tube at a more appropriate position in accordance with the shape and the size of the tube.

According to an embodiment of the invention, a tube pump including the housing to which the above described tube fixing member can be attached is provided. The housing of the tube pump according to an embodiment of the invention includes a support part which supports the first holding part, and a first engagement mechanism which engages with the second engagement mechanism formed on the engagement part of the tube fixing member.

Typically, the support part includes a first flat plate part which is sandwiched between the first holding part and the engagement part of the tube fixing member. The support part may include a second flat plate part which is formed to be parallel with the first flat plate part and which sandwiches the first holding part of the tube fixing member between the second flat plate part and the first flat plate part.

The tube pump may further include a drive unit; and a pump cartridge which is detachably attachable to the drive unit. Typically, the pump cartridge includes a roller, a flexible tube, and a pump cassette on which a wall surface for pressing and flattening the flexible tube between the wall surface and the roller is formed. In this case, it is preferable that the housing is the pump cassette.

The tube pump having the pump cartridge which is detachably attachable to the drive unit is able to considerably enhance the maintenance workability of a pump mechanism (the pump cartridge) which is more frequently subjected to the maintenance. When the present invention is applied to the tube pump configured as described above, the workability for attaching the pump cartridge to the drive unit can be enhanced by fixing an end of the flexible tube to the pump cassette which is the housing of the pump cartridge.

The tube pump further includes a rotor which rotatably supports a plurality of rollers. In this case, the wall surface is a cylindrical first inner wall surface formed on the pump cassette, and on a second inner wall surface of the pump cassette formed to be substantially perpendicular to the first inner wall surface, a rotor support shaft which rotatably supports the plurality of rollers is formed to extend along a center axis of the cylindrical first inner wall surface.

DETAILED DESCRIPTION OF EMBODIMENTS

In the following, embodiments according to the present invention will be described in detail with reference to the accompanying drawings.

First Embodiment

Figure 1:
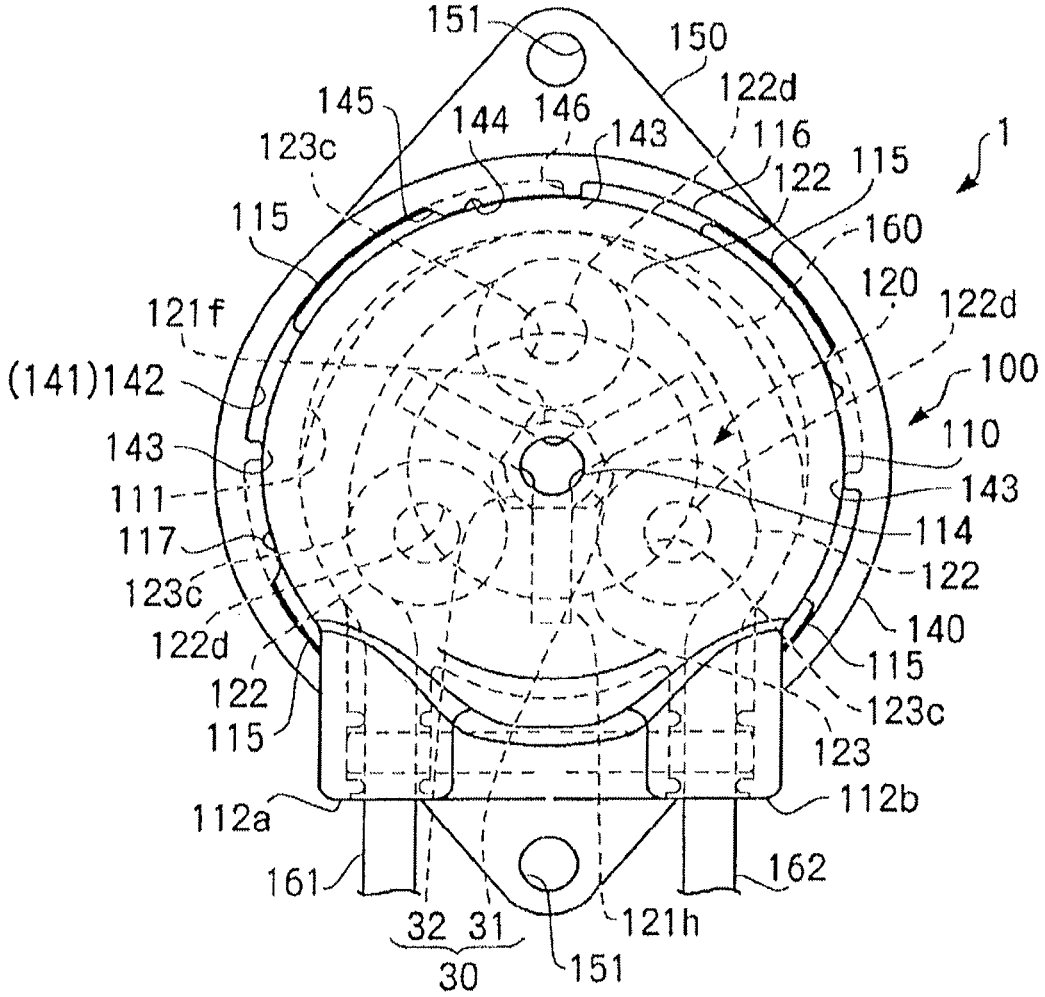
FIG. 1 is a front view of a tube pump according to a first embodiment of the invention.
Figure 2:
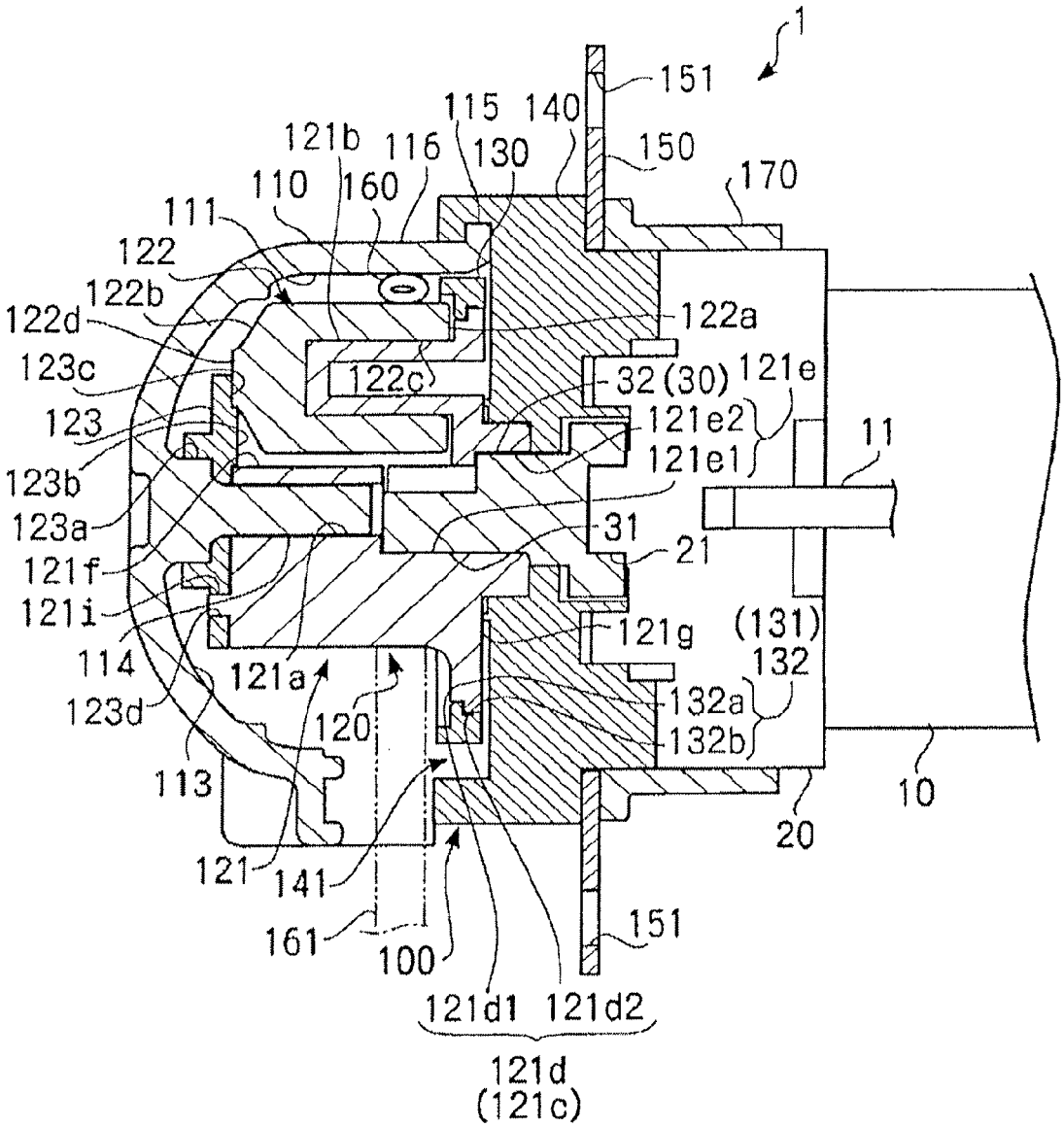
FIG. 2 is a side cross section of the tube pump according to the first embodiment.
Figure 3:
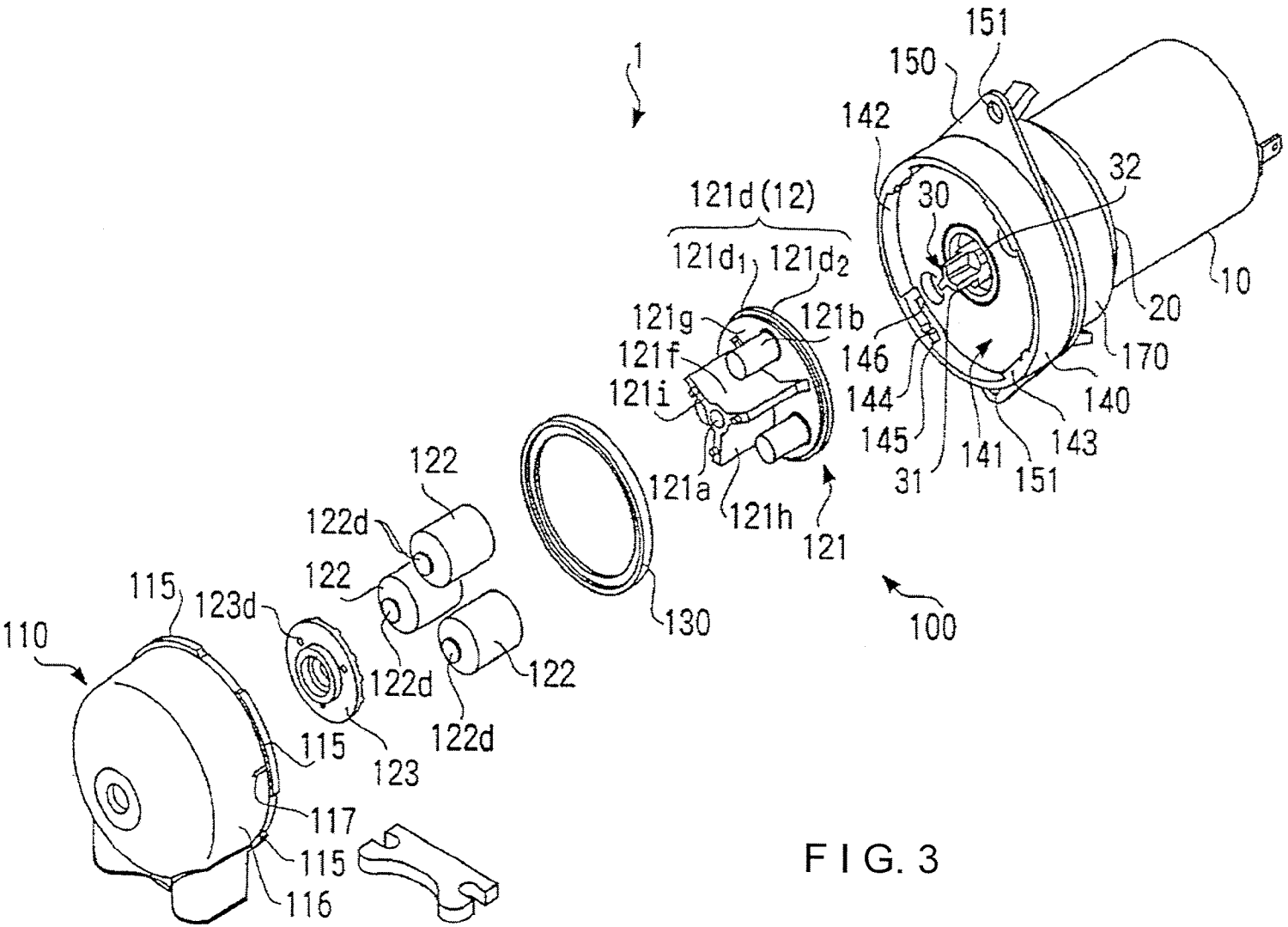
FIG. 3 is an exploded view of the tube pump according to the first embodiment.

Hereafter, a first embodiment according to the invention will be described in detail with reference to the accompanying drawings. FIGS. 1 and 2 respectively illustrate a front view and a side cross sectional view of a tube pump according to the first embodiment. FIG. 3 is an exploded view of the tube pump according to the embodiment. As shown in FIGS. 2 and 3, the tube pump 1 according to the embodiment includes a drive motor 10, a gear box 20 and a pump body 100.

In the following explanation, the side on which the pump body 100 is situated is referred to as a "near side" (the front side in FIG. 2, the left side in FIG. 2, and the lower left side in FIG. 3), and the side on which the drive motor 10 is situated is referred to as a "back side" (the rear side in FIG. 2, the right side in FIG. 2, and the upper right side in FIG. 3). In addition, the direction pointing from the near side to the back side and the direction pointing from the back side to the near side are defined as a depth direction.

The pump body 100 includes a cap 110, a rotor 120, a tube press ring 130 (FIGS. 2 and 3), a base 140, a fixing plate 150 and a plate holding cylinder 170.

As shown in FIGS. 2 and 3, the fixing plate 150 is held by being sandwiched between the base 140 and the plate holding cylinder 170. That is, by fixing the plate holding cylinder 170 to the base 140, the fixing plate 150 is fixed to the base 140. As shown in FIGS. 1 and 3, a pair of through holes 151 is formed in the fixing plate 150. When the tube pump 1 is fixed to, for example, a frame of an apparatus in which the tube pump 1 is used, the fixing plate 150 is fixed to the frame by inserting bolts into the through holes 151.

As described above, in the embodiment, the fixing plate 150 for fixing the tube pump 1 can de detached. Therefore, by using the fixing plate 150 having an appropriate shape in accordance with the shape of a frame to which the tube pump 1 is to be attached, it becomes possible to attach the tube pump 1 to various types of apparatuses.

As shown in FIGS. 1 and 2, an inner circumferential surface 111 of the cap 110 is formed to be a cylindrical surface, and a tube 160 is arranged along the inner circumferential surface 111 (i.e., the long axis of the tube 160 is substantially equal to the circumferential direction of the inner circumferential surface 111). As shown in FIG. 1, a first opening 112*a* and a second opening 112*b* are formed at a lower portion of the cap 110, and a first end 161 and a second end 162 of the tube 160 respectively protrude to the outside of the cap 110 via the first opening 112*a* and the second opening 112*b*.

As shown in FIG. 3, the rotor 120 includes a rotor body 121, three rollers 122, and a rotor presser member 123. As shown in FIG. 2, at a central part of a ceiling 113 situated on the near side in the cap 110, a rotor support shaft 114 is formed to extend from the near side to the back side. Engagement holes 121*a* and 123*a* into which the rotor support shaft 114 is inserted are respectively formed in the rotor body 121 and the rotor presser member 123, and the rotor body 121 and the rotor presser member 123 are rotatably supported by the rotor support shaft 114.

The rotor body 121 includes a disk part 121*g* and three roller support shafts 121*b* extending from a front surface of the disk part 121*g* to the near side. The roller support shafts 121*b* are formed to be along a circumference having its center at the engagement hole 121*a*. The engagement hole 121*a* of the rotor body 121 is formed in the inside of a main support shaft 121*f* extending from a central part of the front surface of the disk part 121*g* to the near side. The roller 122 has a shape of a column, and at a central part of one end surface (back side) 122*a*, a hole 122*c* is formed to extend toward the other end surface (near side) 122*b*. The diameter of the hole 122*c* is determined to be able to slidably accommodate the roller support shaft 121*b* of the rotor body 121. Furthermore, a cylindrical projection 122*d* is formed in the end surface 122*b* of the roller 122. On a back side end face 123*b* of the rotor presser member 123, three recessions 123*c* each of which is able to slidably accommodate the projection 122*d* of the roller 122 are formed along a circumference having a center at the engagement hole 123*a*.

By inserting the roller support shafts 121*b* of the rotor body 121 into the holes 122*c* of the rollers 122, accommodating the projections 122*d* of the rollers 122 in the recessions 123*c* of the rotor presser member 123 and further inserting the engagement holes 123*a* and 121*a* of the rotor presser member 123 and the rotor body 121 into the rotor support shaft 114 of the cap 110, the entire rotor 120 becomes able to rotate about the rotor support shaft 112 and each of the rollers 122 becomes able to rotate around the roller support shaft 121*b* of the rotor body 121. At this time, the main support shaft 121*f* of the rotor body 121 contacts the rotor presser member 123.

As shown in FIGS. 1 and 2, the tube 160 is pressed and flattened between the rollers 122 and the inner circumferential surface of the cap 110, and when the rotor 120 rotates around the rotor support shaft 114 of the cap 110, the rollers 122 cause an orbital motion along the inner circumferential surface 111 of the cap 110 while pressing and flattening the tube 160. As a result, the tube 160 causes a peristaltic motion, and the content in the tube 160 moves. For example, when the rotor 120 is rotated in the clockwise direction in FIG. 1, the content of the tube 160 is transported from the first end protruding from the first opening 112 situated at the lower left toward the second end 162 protruding from the second opening 112*b* situated at the lower right. Thus, the content of the tube 160 can be transported by driving the rotor 120.

The cap 110 is configured to be fixed to the base 140. When the cap 110 is fixed to the base 140, the rotor 120 is held by being sandwiched between the cap 110 and the base 140.

As shown in FIG. 2, on the outside of the rotor body 121 in the radial direction, the tube press ring 130 having the diameter slightly larger than that of the rotor body 121 is arranged. On an inner circumferential surface 131 of the tube press ring 130, a step 132 is formed such that a small diameter part 132*a* is situated on the near side and a large diameter part 132*n* is situated on the back side. On a cylindrical outer circumferential surface 121*c* of the rotor body 121, a step 121*d* is formed such that a small diameter part 121*d*1 is situated on the near side and a large diameter part 121*d*2 is situated on the back side. The diameter of the small diameter part 132*a* of the tube press ring 130 is slightly larger than the diameter of the small diameter part 121*d*1 of the rotor body 121 and is smaller than the large diameter part 121*d*2. Furthermore, the large diameter part 132*b* of the tube press ring 130 is slightly larger than the diameter of the larger diameter part 121*d*2 of the rotor body 121. Therefore, in a state where the tube press ring 130 is attached to the rotor body 121, the step 121*d* of the rotor body 121 engages with the step 132*b* of the tube press ring 130, and as a result the tube press ring 130 does not move to the back side of the rotor body 121 and the tube press ring 130 is able to rotate while sliding on the rotor body 121. In a state where the cap 110 and the tube press ring 130 are attached to the rotor body 121, the centers of the outer circumferential surface 121*c* of the rotor body 121 and the inner circumferential surface 131 of the tube press ring 130 substantially coincide with the center axis of the rotor support shall 114 of the cap 110.

As shown in FIG. 2, the tube press ring 130 is arranged to seal the gap between the rollers 122 of the rotor 120 and the inner circumferential surface 111 of the cap 110. With this configuration, when the tube pump 1 operates, the tube 160 is prevented from running off the gap between the rollers 122 and the inner circumferential surface 111 of the cap 110 even if the tube 160 moves to the back side.

In a configuration where the tube pump 1 does not have the tube press ring 130 and instead the disk par 121*g* of the rotor body 121 is formed to seal the gap between the rollers 122 and the inner circumferential surface 111 of the cap 110, there is a possibility that, when the tube 160 moves to the back side and thereby contacts the disk part 121*g* of the rotor body 121, the tube 160 is drawn in the direction of the orbital motion of the rollers 122 by the frictional force acting on the disk part 121*g* and the tube 160, and the tube is damaged.

By contrast, in the tube pump 1 according to the embodiment, the tube press ring 130 capable of rotate with respect to the disk part 121*g* of the rotor body 121 serves to prevent the tube 160 from running off the gap between the rollers 122 and the inner circumferential surface 111 of the cap 110. In such a configuration, when the tube 160 moves to the back side and contacts the tube press ring 130, the tube press ring 130 stays still without following the rotation of the rotor body 121 due to the frictional force acting between the tube 160 and the tube press ring 130, and thereby the tube 160 is prevented from being drawn in the direction of the orbital motion of the rollers 122 by the rotation of the rotor 120 and is prevented from being damaged.

Since, as described above, the tube pump 1 according to the embodiment is configured such that the gap between the rollers 122 of the rotor 120 and the inner circumferential surface 111 of the cap 110 is sealed by the tube press ring 130 attached to the rotor body 121, the tube 160 can be installed in the tube pump 1 through an easy work in which the rotor 120 is formed by combining the rollers 122 and the rotor presser member 123, the tube 160 is arranged around the rollers 122 of the rotor 120, and then the tube 160 is pressed into the cap 110 together with the rotor 120 and the tube press ring 130.

Next, an attachment mechanism for attaching the cap 110 to the base 140 is explained. As shown in FIGS. 1 to 3, at the back side end portion of an outer circumferential surface 116 of the cap 110, four nails 115 protruding outward in the radial direction and in a shape of a flange are formed at constant intervals (i.e., every 90 degrees). A recession 141 for accommodating the back side part and the nails 115 of the cap 110 is formed on the base 140, and at the near side end of an inner circumferential surface 142 of the recession 141, four nails 143 protruding inward in the radial direction are formed at constant intervals (i.e., every 90 degrees). Tips of the four nails 115 of the cap 110 in the radial direction are arranged along a circumference concentric with the outer circumferential surface 116 of the cap 110, and the diameter of the circumference is slightly smaller than the inner circumferential surface 142 of the case 140. Tips of the four nails 143 of the base 140 are arranged along a circumference concentric with the inner circumferential surface 142 of the case 140, and the diameter of the circumference is substantially equal to the diameter of the outer circumferential surface of the cap 110 and is smaller than the circumference on which the four nails 115 are positioned. Furthermore, the size of the nail 115 of the cap 110 in the circumferential direction is sufficiently smaller than the interval between the nails 143 of the base 140 in the circumferential direction (i.e., the length, in the circumferential direction, of each of four regions where the nails 143 are not provided on the inner circumferential surface 142).

The cap 110 is attached to the base 140 by inserting the nails 115 to the recession 141 of the base so as not to interfere with the nails 143 of the base 140, by rotating the cap 110 about the rotor support shaft 114 of the cap 110 in the clockwise direction in FIG. 1, and by moving the nails 115 of the cap 110 to the positions at which the nails 115 are aligned with the nails 143 of the base 140 in the depth direction. In the state where the nails 115 of the cap 110 are aligned with the nails 143 of the base 140 in the depth direction, the nails 115 of the cap 110 engage with the nails 143 of the base 140, and therefore the cap 110 is not removed from the base 140 even if the cap 110 is drawn from the base 140 to the near side.

In the tube pump 1, the tube 160 is constantly pressed against the inner circumferential surface 111 of the cap 110 by the rotor 120, and a load pointing outward in the radial direction is applied constantly to the cap 110. As described above, in this embodiment, the nails 143 of the base 140 contact the outer circumferential surface 116 of the cap 110 in the state where the cap 110 is attached to the base 140. Therefore, the nails 143 reinforce the cap 110 from the outside in the radial direction, and deformation of the cap 110 by the load pointing to the outside in the radial direction can be suppressed.

At the near side portions of the nails 115 on the outer circumferential surface 116 of the cap 110, engagement projections 117 each having a shape of a pin are provided to protrude outward in the radial direction and to extend in the depth direction (FIGS. 1 and 3). On the nails 143 of the base 140, engagement recessions 144 are formed to be recessed outward in the radial direction. At an end of the nail 143 of the base 140 in the circumferential direction, a slanting surface 145 is formed to become closer to the inner circumferential surface 142 of the case 140 toward the clockwise direction. Therefore, when the cap 110 is inserted into the recession 141 of the case 140 and then the cap 110 is rotated in the clockwise direction in FIG. 1, the engagement projections 117 of the cap 110 move along the slanting surfaces 145 of the nails 143 of the base 140 and are finally fitted into the engagement recessions 144, respectively. In the state where the engagement projections 117 are fitted into the engagement recessions 144, the engagement between the engagement projections 117 and the engagement recessions 144 are such that the cap 110 cannot be removed unless the cap 110 is rotated in the counter clockwise direction with a strong force. That is, thanks to the engagement between the engagement projections 117 and the engagement recessions 144, the cap 110 is engaged with the base 140.

As described above, in this embodiment, the cap 110 is locked to the base 140 by the engagement projections 117 provided on the outer circumferential surface 116 of the cap 110. In the conventional structure where engagement projections or engagement recessions are formed on a nail which is a low rigidity part of a cap, a large load may be applied to the nail for engagement, and thereby the nail may be damaged. By contrast, since, according to the embodiment, the engagement projections 117 are provided on the outer circumferential surface 116 having a relatively high degree of rigidity, the cap 110 hard to be damaged when the cap 110 is attached.

At a portion of the other end (at the counterclockwise end portion in FIG. 1) of the nail 143 in the circumferential direction on the inner circumferential surface of the base 140, a stopper 146 having a smaller diameter is formed (see FIGS. 1 and 3). In the case where the cap 110 is rotated in the clockwise direction in FIG. 1 from the state where the engagement projections 117 are fitted into the engagement recessions 144, even when the engagement between the engagement projections and the engagement recessions 144 is released, the nail 115 interferes with the stopper 146 and thereby the cap 110 is prevented from rotating in the clockwise direction further more. That is, the stopper 146 functions as a stopper for stopping the movement of the cap in the clockwise direction in FIG. 1 from the state where the engagement projections 117 are fitted into the engagement recessions 144.

Although, in this embodiment, the engagement projections 117 are provided on the cap 110 and the engagement recessions are formed on the base 140, engagement recessions formed to be recessed inward in the radial direction of the cap 110 may be provided on the cap 110, and engagement projections protruding outward in the radial direction of the case may be provided on the base 140.

Next, a mechanism for rotating the rotor 120 of the pump body 100 is explained. As shown in FIG. 2, a rotation shaft 11 of the drive motor 10 is connected to the gear box 20. The gear box 20 transmits the rotational motion of the rotation shaft of the drive motor 10 to an output shaft 21 of the gear box 20 while decelerating the rotational motion. To the output shaft 21 of the gear box 20, a joint shaft 30 for transmitting the rotational motion of the output shaft 20 to the rotor body 121 of the rotor 120 is connected.

Figure 4:
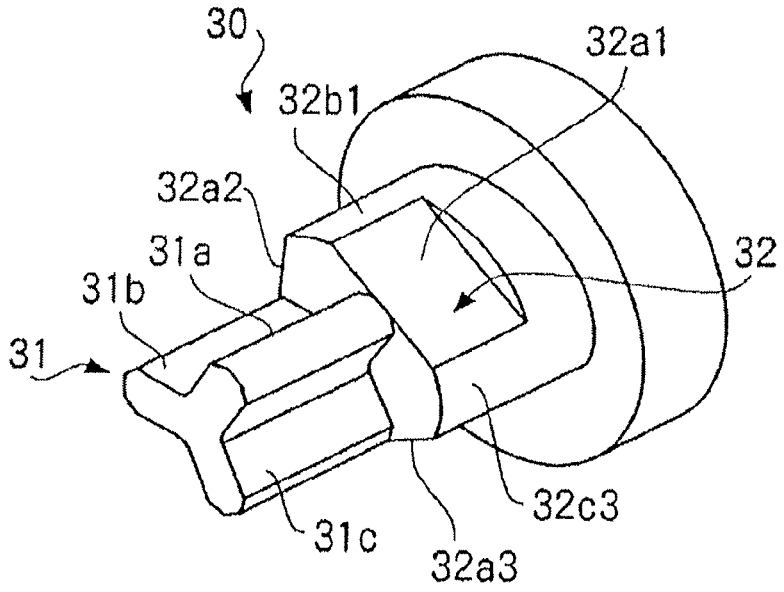
FIG. 4 is a perspective view of a joint shaft of the tube pump according to the first embodiment.
Figure 5:
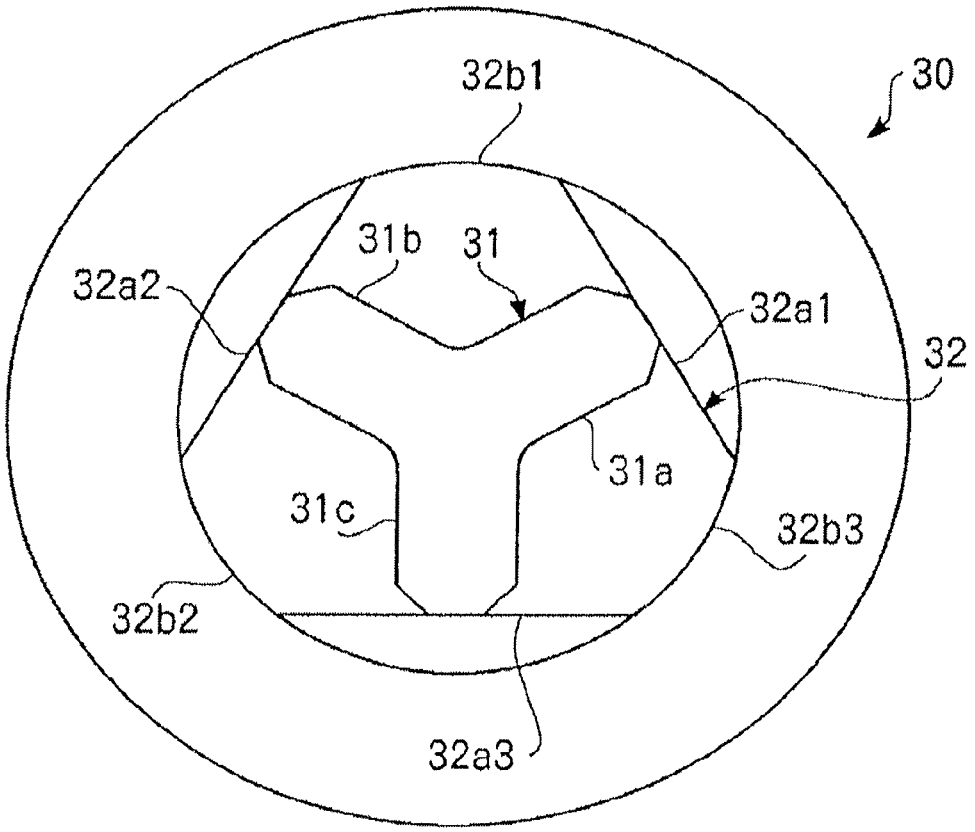
FIG. 5 is a front view of the joint shaft of the tube pump according to the first embodiment.

Hereafter, a joint mechanism between the joint shaft 30 and the rotor body 121 is explained. FIG. 4 is a perspective view of the joint shaft 30. FIG. 5 is a front view of the joint shaft viewed from the near side (the lower tell side in FIG. 4). As shown in FIG. 4, at a tip of the near side (i.e., the rotor body 121 side) portion of the joint shaft 30, a positioning shaft part 31 having the cross section form in a shape of a letter "Y" (i.e., the shape in which arms 31*a*, 31*b* and 31*c* radially extend from a center axis line 30A of the joint shaft) is formed.

At a portion adjoining the back side portion of the positioning shall part 31 of the joint shaft 30, an engagement shaft part 32 is formed. The engagement shaft part 32 includes flat surface parts 32*a*1, 32*a*2 and 32*a*3 formed by cutting a cylindrical shaft by planes which are perpendicular to directions in which the arms 31*a*, 31*b* and 31*c* of the positioning shall part 31 extend, at the positions of the tips f the arms 31*a*, 31*b* and 31*c*, respectively, and cylindrical surfaces 32*b*1, 32*b*2 and 32*b*3 respectively formed between the flat surface parts 32*a*1 and 32*a*2, between the flat surface parts 32*a*2 and 32*a*3 and between the flat surface parts 32*a*3 and 32*a*1. On the whole, the engagement shaft part 32 is formed to have a triangular cross section.

Figure 6:
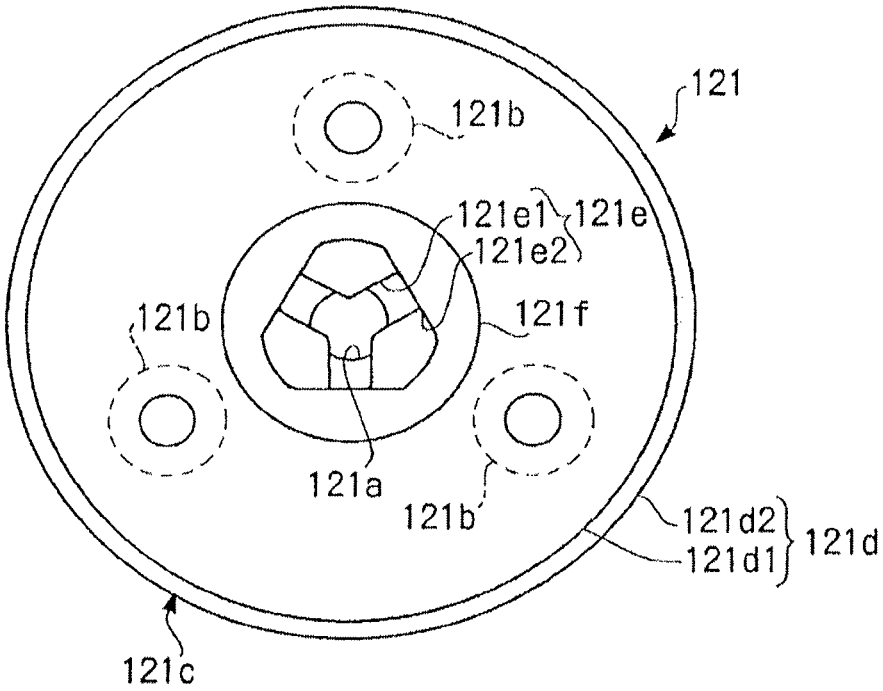
FIG. 6 is a rear view of a rotor body of the tube pump according to the first embodiment.

In this embodiment, the positioning of the joint shaft 30 around the shaft with respect to the rotor body 121 is performed by the positioning shaft part 31 arranged on the near side, and the joint shaft 30 and the rotor body 121 become able to rotate together by the engagement shaft part 32. FIG. 6 is a rear view of the rotor body 121. As shown in the cross sectional view of FIG. 2 and the rear view of FIG. 6, an engagement hole 121*e* for engaging with the engagement shaft is formed in the rotor body 121.

As shown in the cross sectional view of FIG. 2, the engagement hole 121*e* is a hole having a step, and includes a positioning hole part 121*e*1 situated on the near side and an engagement hole part 121*e*2 situated on the back side. The engagement hole part 121*e*2 is formed to have a triangular cross section which is substantially equal to the engagement shaft part 32 of the joint shaft 30, and the rotor body 121 and the joint shaft 30 become able to rotate together by the engagement between the flat surface parts 32*a*1, 32*a*2 and 32*a*3 of the engagement shaft part 32 (see FIGS. 4 and 5) and the engagement hole part 121*e*2. On the other hand, the positioning hole part 121*e*1 has a cross section having a shape of a letter "Y" which is substantially equal to the positioning shall part 31 (see FIGS. 4 and 5), and after inserting the positioning shaft part 31 to the positioning hole part 121*e*1, the engagement shaft part 32 can be engaged with the engagement hole part 121*e*2 by only moving the joint shaft 30 to the rotor body 121 along the positioning hole part 121*e*1.

After the tube 160 is attached to the position between the cap 110 and the rollers 122 (see FIGS. 1 and 2), the cap 110, the rotor 120, the tube 160 and the tube press ring 130 form an integrated pump side unit by the frictional force acting between the cap 110, the rollers 122 and the tube 160. When the joint shaft 30 is attached to this unit, a gear box side unit is formed by first fixing the joint shaft 30 to the output shaft 21 of the gear box 30, and then fixing the base 140 to the gear box 20 with a bolt (not shown). Then, the engagement shaft part 32 of the joint shaft 30 is engaged with the engagement hole part 121*e*2 of the rotor body 121, and finally the cap 110 is fixed to the base 140.

It is preferable that the positioning between the engagement shaft part 32 of the joint shaft 30 and the engagement hole part 121*e*2 of the rotor body 121 is performed in the state where the base 140 does not interfere with the cap 110 or the rotor body 121, i.e., in the state where the cap 110 is away from the base 140 to some extent. As to a large size tube pump in which a larger size can be secured for the cap 110 and the rotor 120 in the depth direction, it is possible to perform the positioning in the state where the cap 110 is away from the base 140 to some extent by securing a long size for the engagement shaft part 32 (the engagement shaft part 32 functions as a positioning shaft part). However, as to a compact size tube pump in which a large size in the depth direction cannot be secured for the cap 110 and the rotor 120, in the configuration where the positioning shaft part 31 is not provided on the joint shaft 30, a large size cannot be secured for the engagement shaft 32 in the depth direction, and thereby it becomes necessary to perform the positioning while contacting the engagement shaft part 32 with the rotor body 121 and sliding them with respect to each other. Therefore, the cap 110 is inevitably situated near the base 140. For this reason, the cap 110 or the rotor body 121 easily interfered with the base 140, and therefore the positioning work for the engagement shaft part 32 of the joint shaft 30 and the engagement hole part 121*e*2 of the rotor body 121 was not easy. By contrast, according to the embodiment, since the positioning shaft part 31 is formed on the joint shaft 30, the positioning work for the engagement shaft part 32 of the joint shaft 30 and the engagement hole part 121*e*2 of the rotor body 121 can be performed easily. Furthermore, since there is no necessity to transmit torque from the gear box 20 to the rotor 120, it is not necessary to increase the diameter thereof. Therefore, the main support shaft 121*f* in which the positioning shaft part 31 is accommodated can be made slender.

Figure 7:
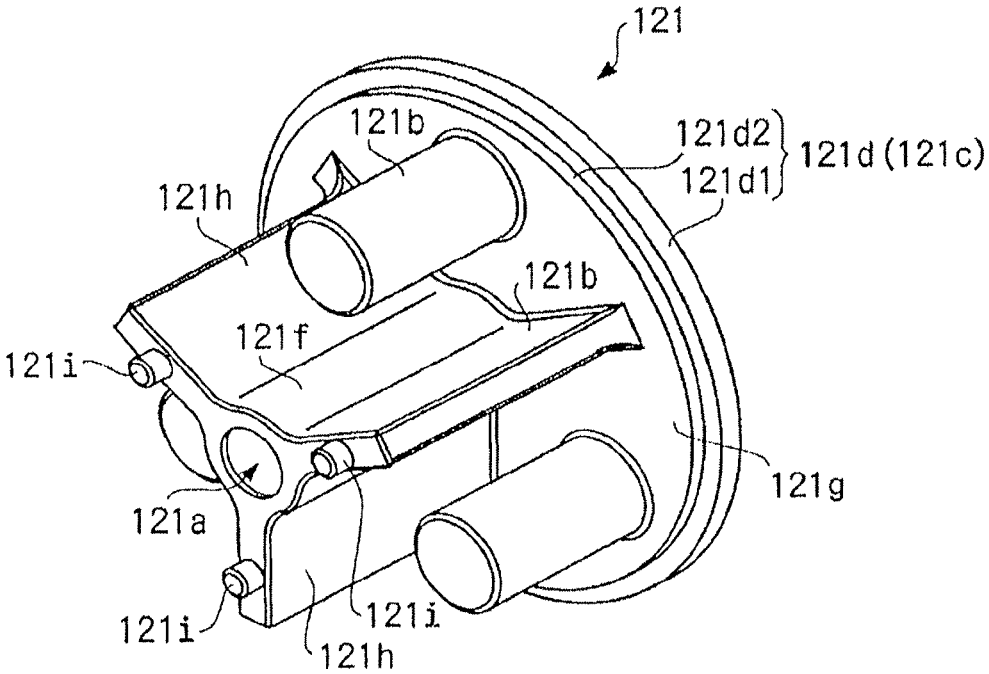
FIG. 7 is a perspective view of the rotor body of the tube pump according to the first embodiment.

Next, the shape of the rotor 121 is explained. FIG. 7 is a perspective view of the rotor body 121 according to the embodiment. In this embodiment, as shown in FIGS. 1, 2 and 7, three ribs 121*h* are formed between the main support shaft 121*f* of the rotor body 121 and the disk part 121*g*. As shown in FIG. 1, each of the three ribs is located between the rollers 122.

On the near side surfaces of the ribs 121*h*, engagement projections 121*i* are formed. As shown in FIG. 2, on the rotor presser member 123, through holes 123*d* into which the engagement projections 121*i* are fit are formed.

Figure 8:
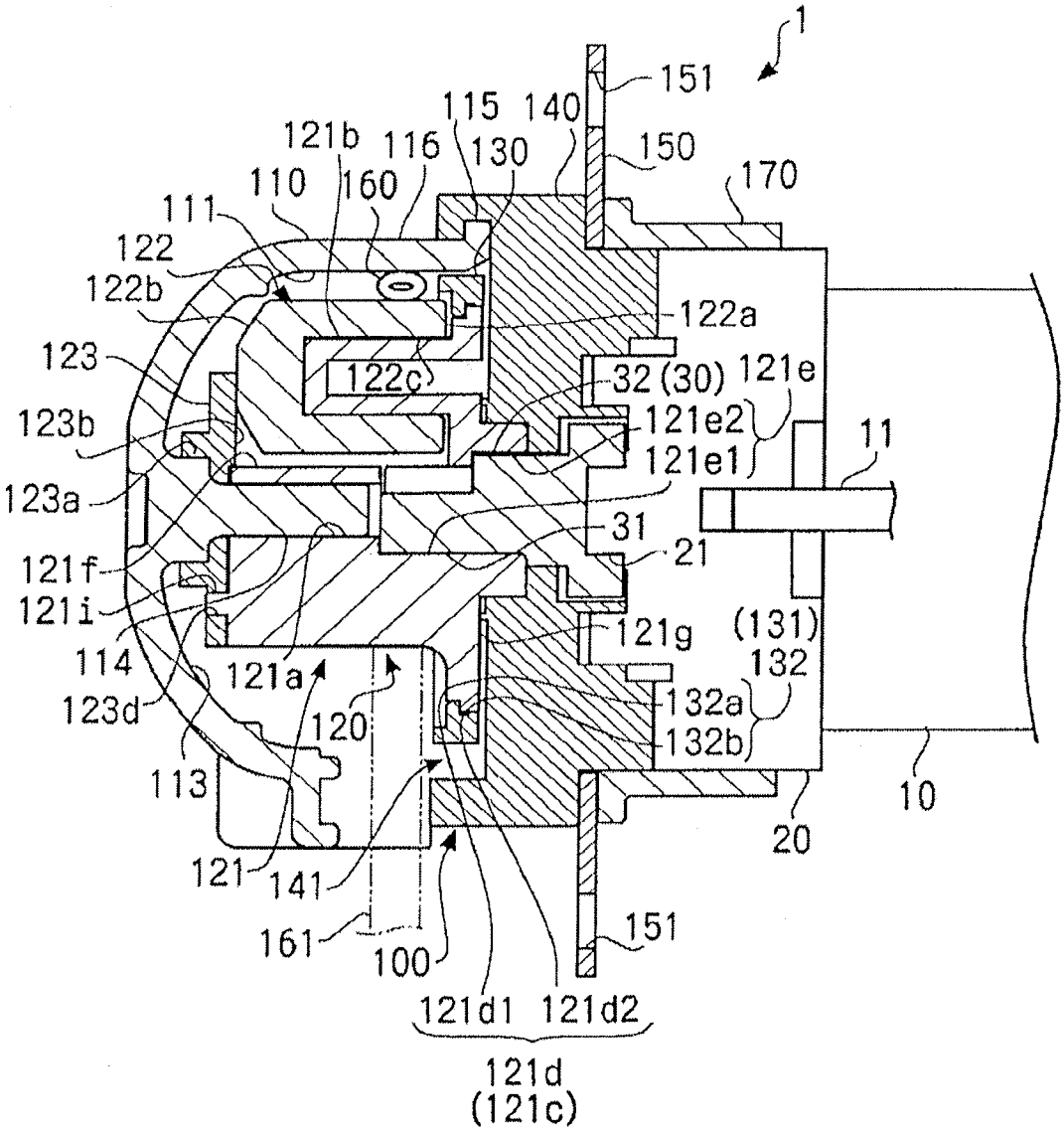
FIG. 8 is a side cross section of the tube pump of another example of the first embodiment.
Figure 9:
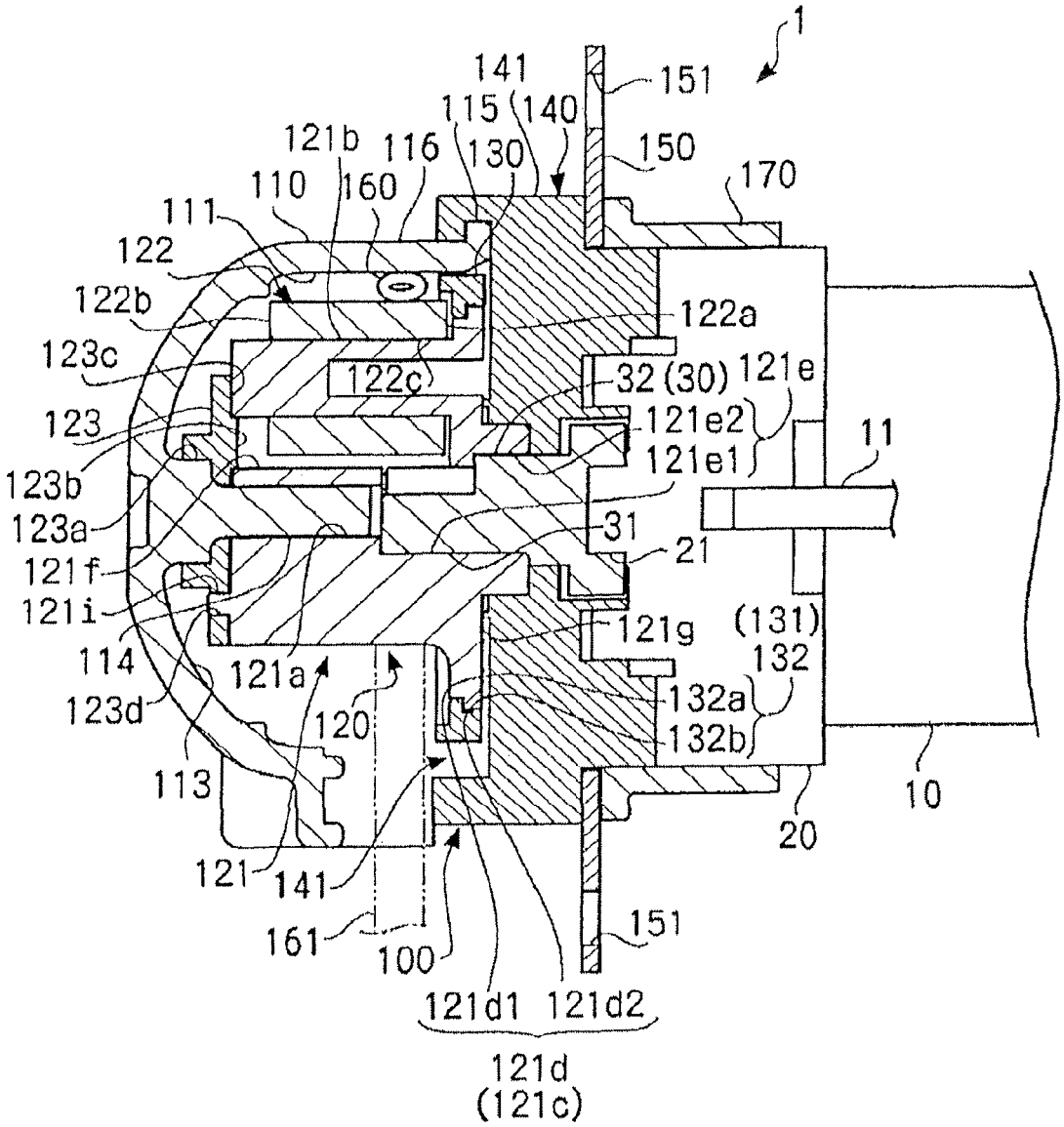
FIG. 9 is a side cross section of the tube pump of another example of the first embodiment.
Figure 10:
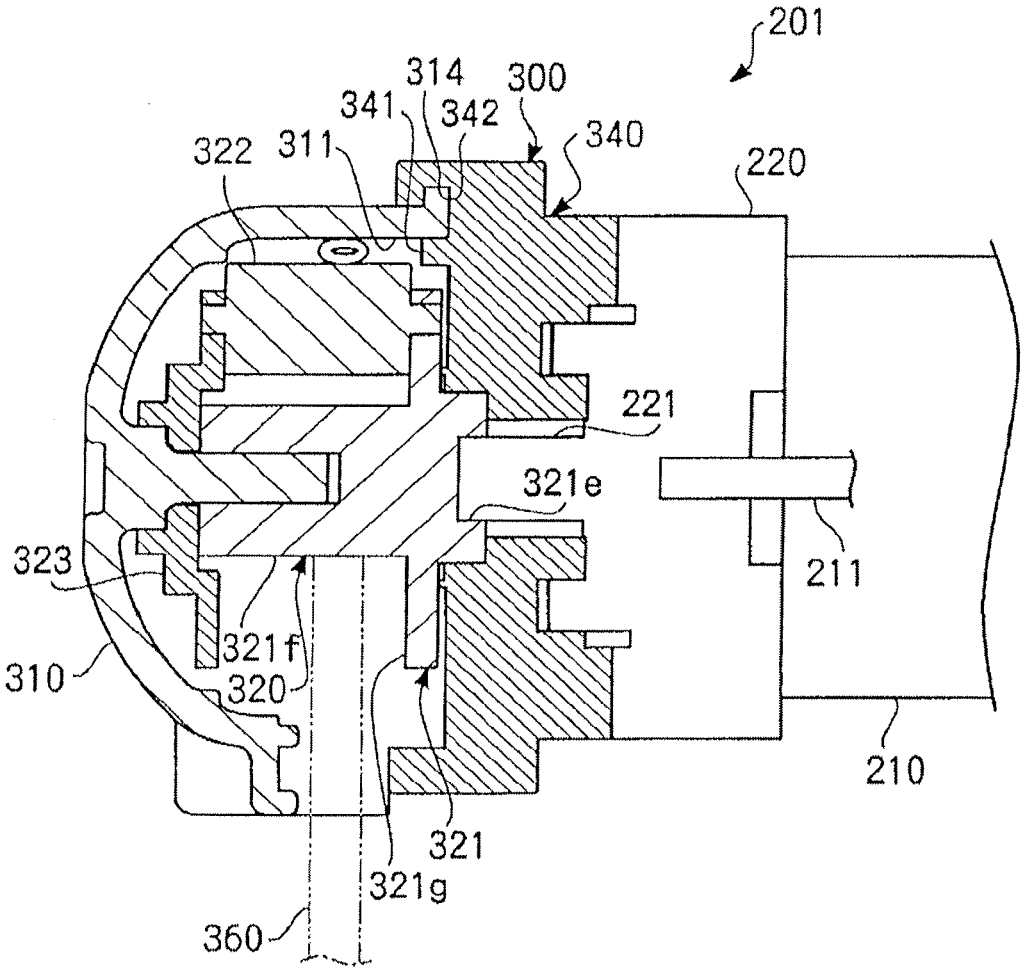
FIG. 10 is a side cross section of a conventional tube pump.

In a configuration where the ribs 121*h* are not formed on the rotor body 121, a large degree of torque is applied to the main support shaft 121*f*. Therefore, it is necessary to thicken the main support shaft 121*f* so that the main support shaft 121*f* is not damaged. In this embodiment, the main support shaft 121*f* is reinforced by the ribs 121*h*, and further the rotor presser member 123 is coupled to the ribs 121*h* via the engagement projections 121*i*. Therefore, even if the main support shaft 121*f* is slender, the main support shaft 121*f* is not damaged. Since the main support shaft 121*f* can be made slender, it is possible to make the diameter of the roller support shaft 121*b* large. As described above, in this embodiment, the diameter of the roller support shaft 121*b* can be made large. Therefore, as shown in FIG. 8, in this embodiment, it is possible to support the roller 122 only by the roller support shaft 121*b* in a cantilever manner, without providing the projection 122*d* on the roller 122 as shown in a cross sectional view of FIG. 8. Alternatively, as shown in a cross sectional view of FIG. 9, the hole 122*c* of the roller 122 may penetrate through the roller 122, and the roller support shaft 121*b* may be formed to protrude from the near side end surface 122*b* of the roller 122 and to be accommodated in the recess 123*c* of the rotor presser member 123 (i.e., the roller support shaft 121*b* also serves as the function of the projection 122*d*).

Since, in this embodiment, the diameter of the roller 122 can be made large, it becomes possible to make a contact area between the roller 122 and the tube 160 can be made large, and thereby the load applied to the tube 160 can be dispersed. As a result, stretching of the tube 160 becomes relatively small, and the tube 160 is not damaged easily (i.e., the lifetime of the tube 160 can be increased).

Since, in this embodiment, the range of the diameter of the available roller 122 is large, the roller 122 having an appropriate diameter can be used in accordance with the thickness, material or the wall thickness of the tube 160.

As described above, according to the embodiment, the long lifetime tube pump in which the damage to the tube is hard to occur, the tube pump capable of securing the large diameter of the roller, and the tube pump in which the drive unit can be attached to the rotor though an easy work can be realized.

Second Embodiment

Figure 11:
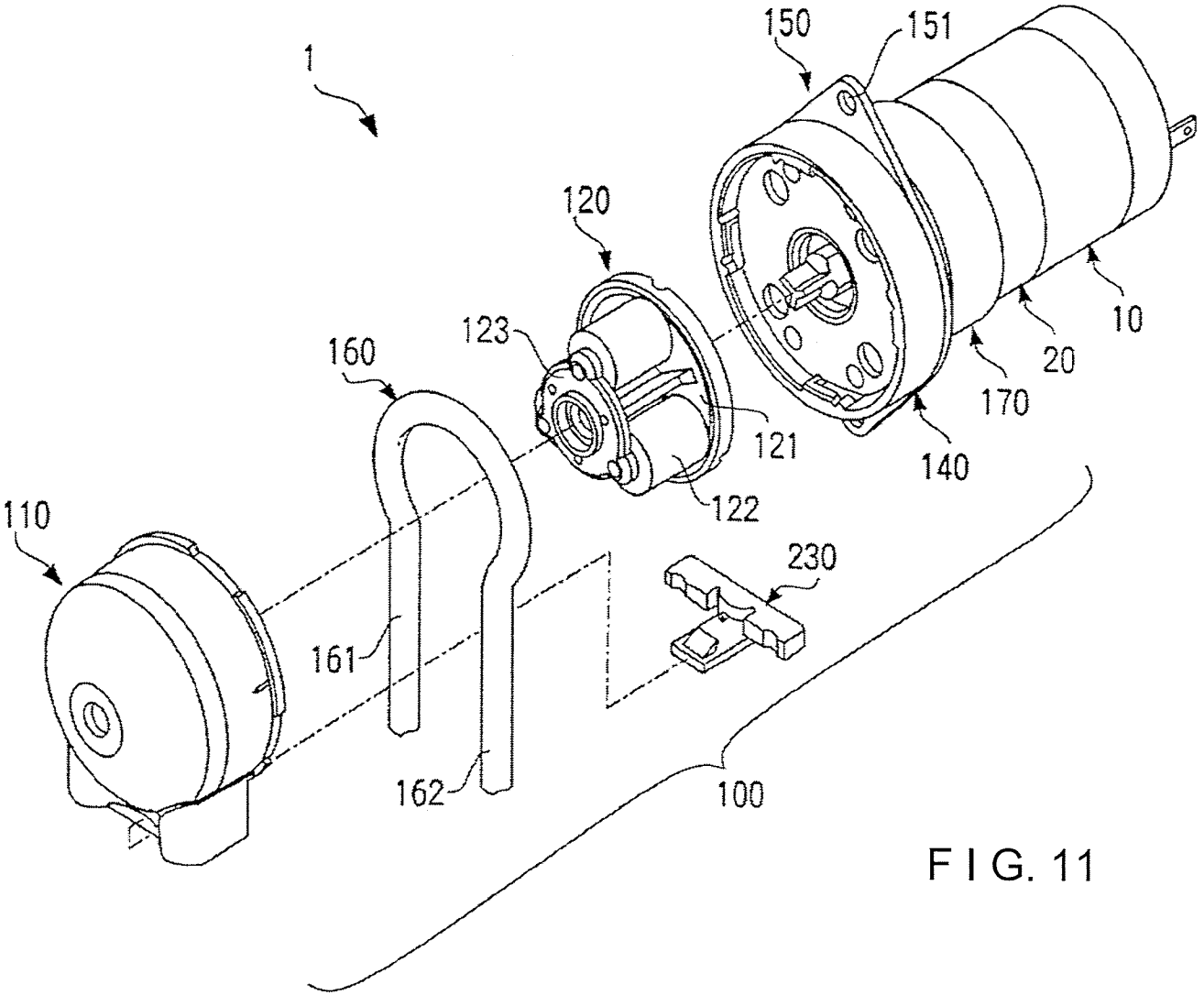
FIG. 11 is an exploded view of a tube pump according to a second embodiment.
Figure 12:
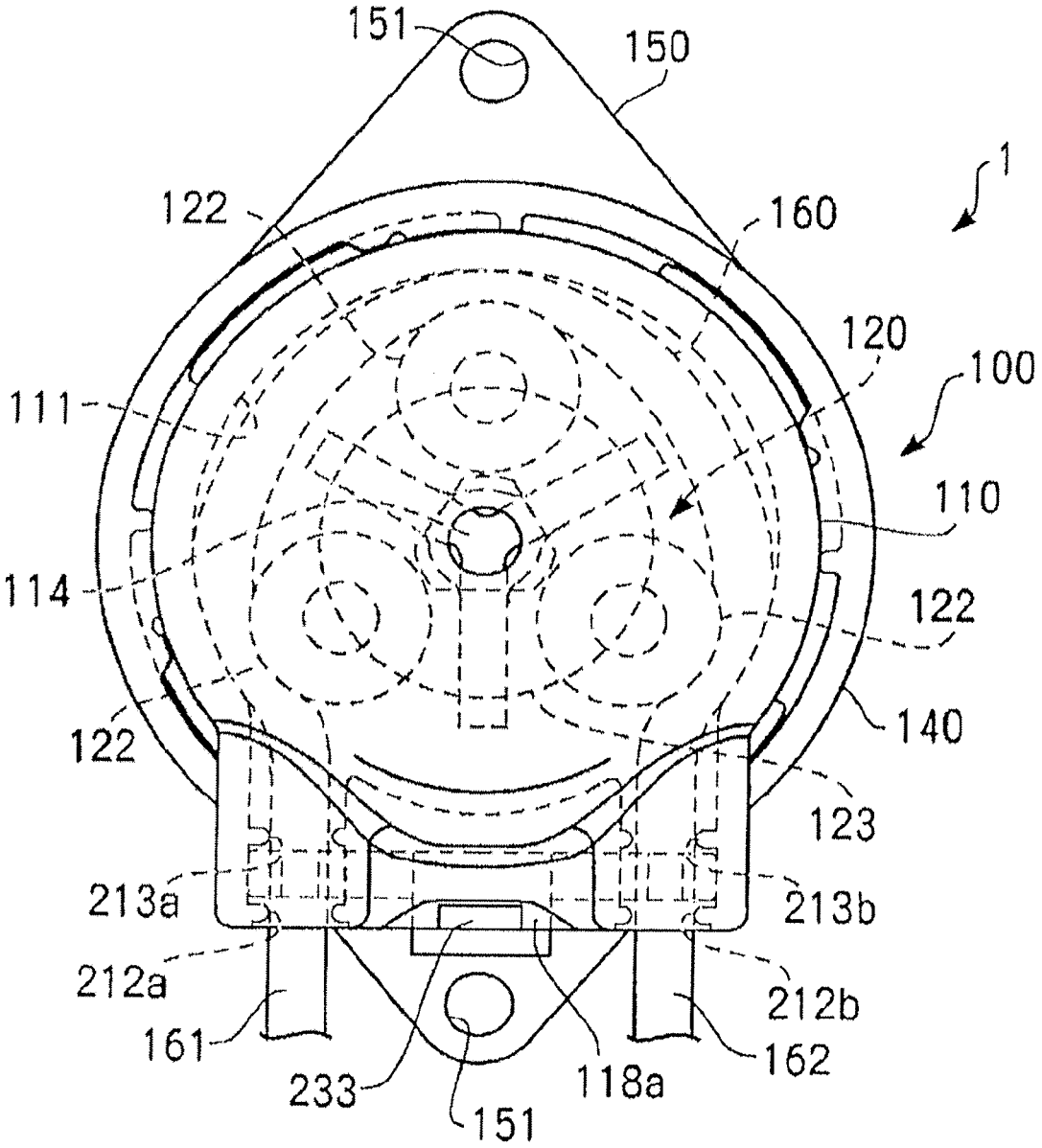
FIG. 12 is a front view of the tube pump according to the second embodiment.
Figure 13:
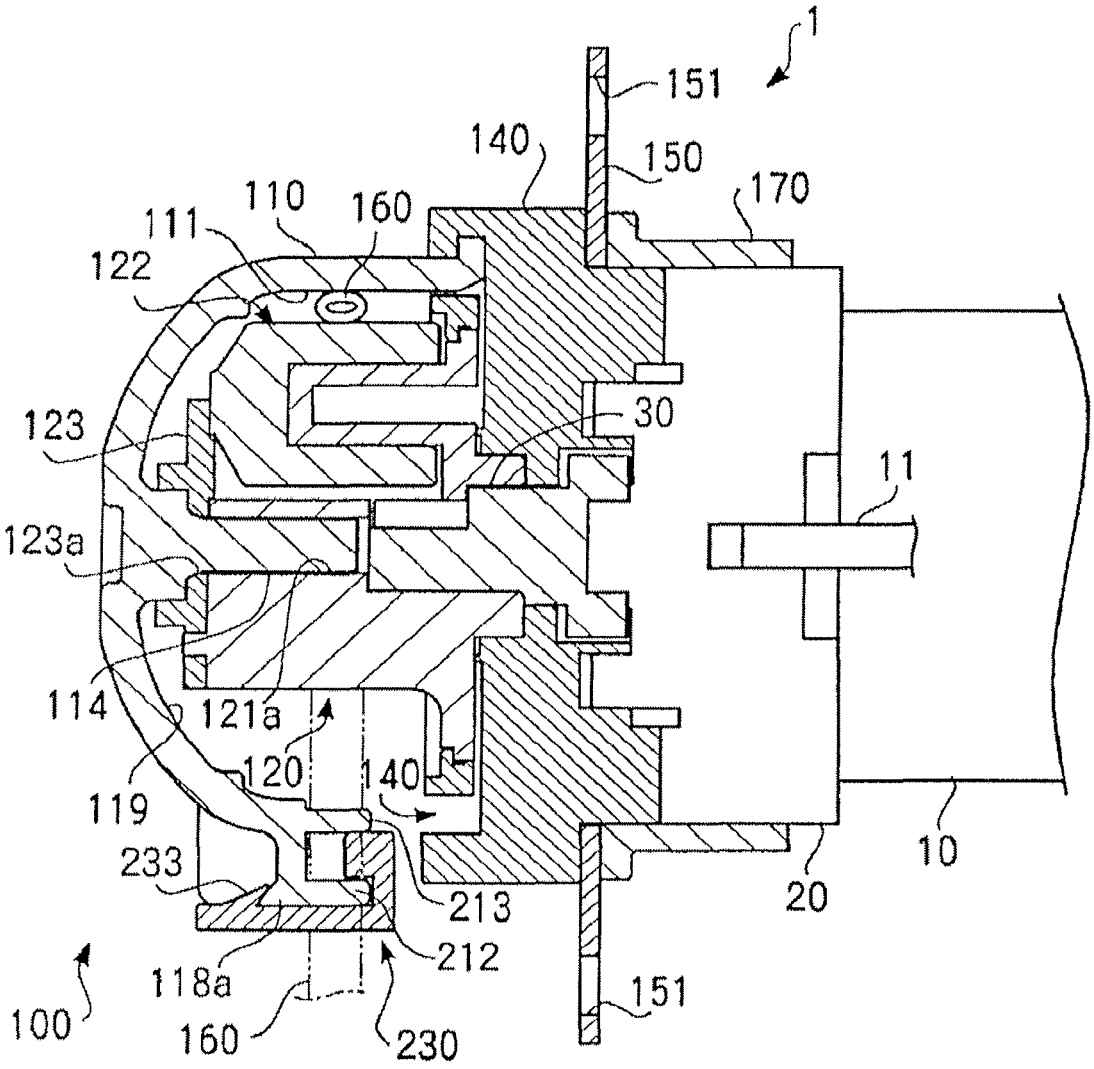
FIG. 13 is a vertical cross section of the tube pump according to the second embodiment.
Figure 14:
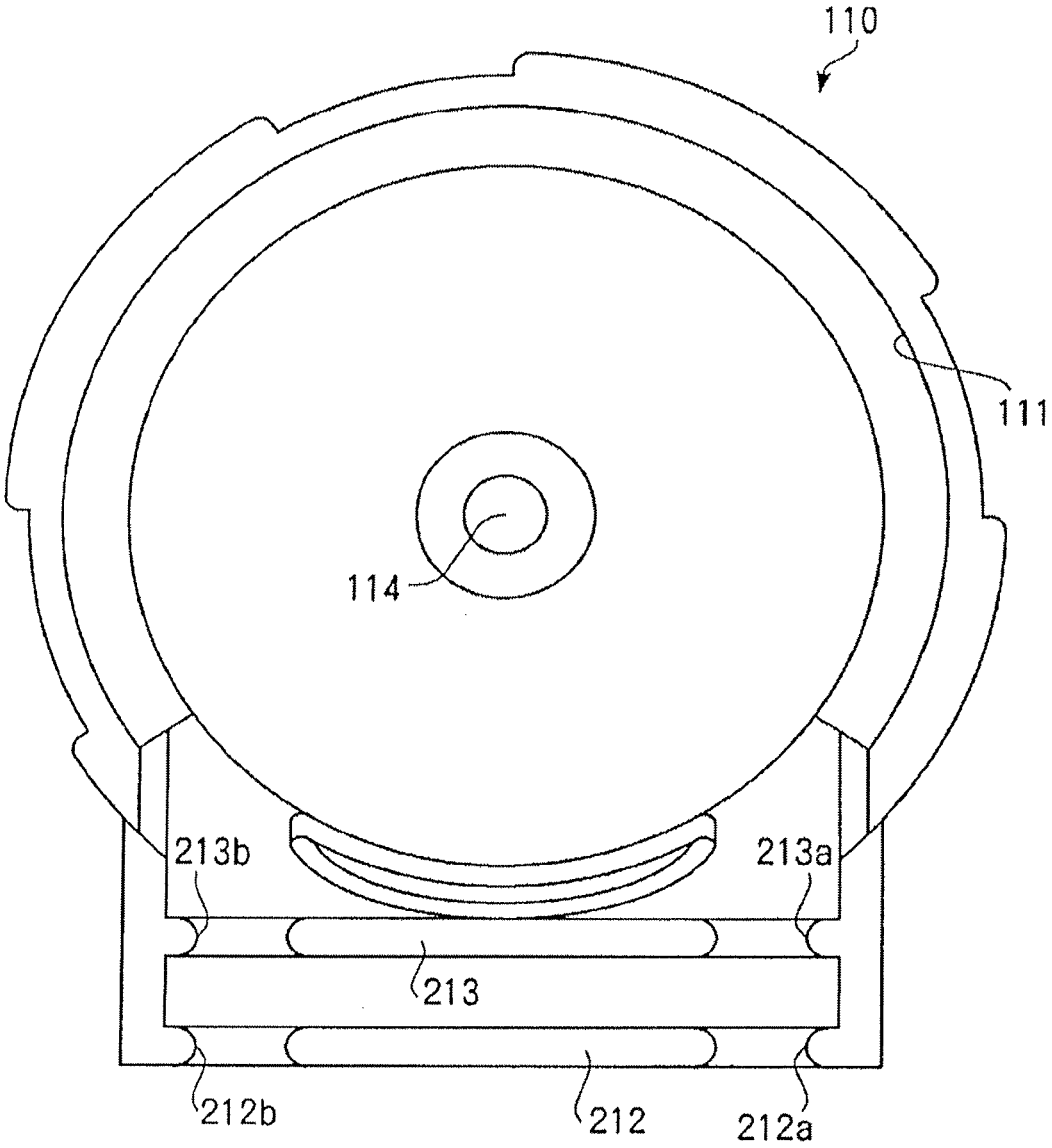
FIG. 14 is a rear view of a pump cassette of the tube pump according to the second embodiment.
Figure 15:
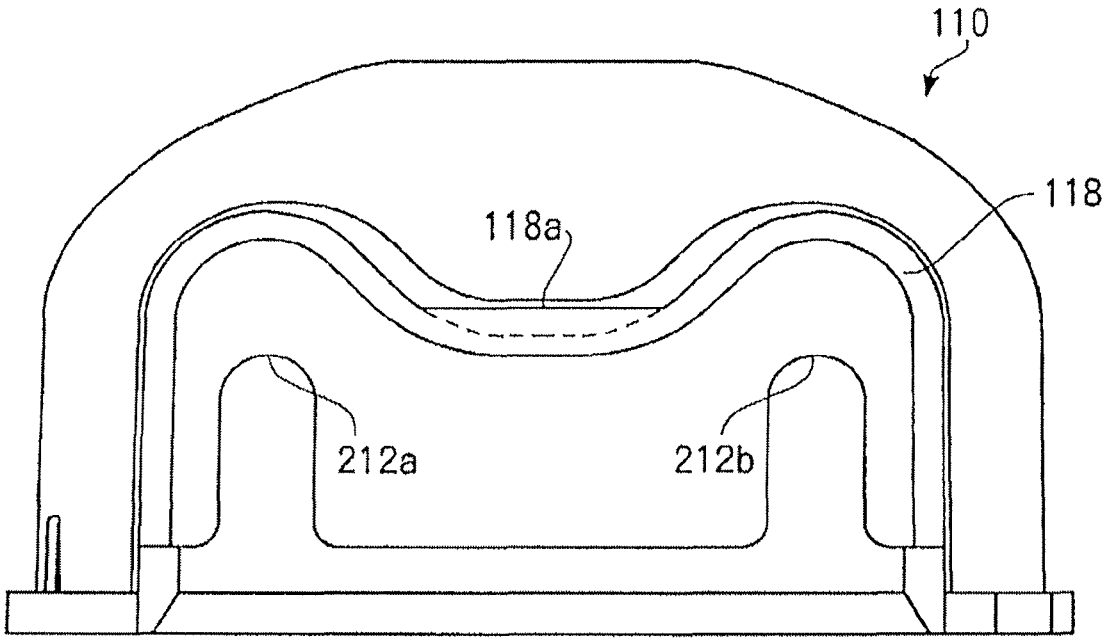
FIG. 15 is a bottom view of the pump cassette of the tube pump according to the second embodiment.

Hereafter, a second embodiment is explained in detail with reference to the drawings. For convenience of explanations, to elements which are substantially the same as those of the first embodiment, the same reference numbers are assigned. FIG. 11 is an exploded perspective view of the tube pump 1 according to the second embodiment of the invention. FIGS. 12 and 13 are the front view and the vertical cross section of the tube pump 1, respectively. FIGS. 14 and 15 are the rear view and the bottom view of a pump cassette 110 shown in FIG. 11.

As shown in FIG. 11, the tube pump 1 includes the drive motor 10, the gear box 20 and the pump body 100. The torque of the axial output produced by the drive motor 10 is amplified by the gear box 20, and is supplied to the pump body 100.

In the following explanations. The pump body 100 side of the tube pump 1 (the lower left side in FIG. 11, the front side on the paper face of FIG. 12, and the left side of FIG. 13) is defines as the "near side", and the drive motor 10 side (the upper right side of FIG. 11, the rear side in FIG. 12, and the right side of FIG. 13) is defined as the "back side". In addition, the direction pointing from the near side to the back side and the direction pointing from the back side to the near side are defined as the depth direction. The upper side and the lower side in FIGS. 12 and 13 are defined as the "upper side" and the "lower side", respectively.

The pump body 100 includes a pump cassette 110, the rotor 120, the base 140, the fixing plate 150, the tube 160, the plate holding cylinder 170 and a tube stabilizer (a tube fixing member) 230 according to the embodiment. A part of the tube 160 and the rotor 120 are arranged in an operation chamber surrounded by the pump cassette 110 and the base 140.

The pump cassette 110 is a bowl-shaped member formed with transparent resin, such as PP (polypropylene), by injection molding. The material of the pump cassette 110 is not limited to the transparent resin, but various types of general structural materials may be used. However, by using the transparent resin, it becomes possible to easily observe the inner condition, and therefore maintenance can be enhanced. In the pump cassette 110, the tube 160, the rotor 120 and the tube stabilizer 230 are attached, and thereby a pump cartridge detachable attachable to the base 140 can be formed. Structures of parts of the pump cassette 110 are explained later.

The fixing plate 150 is formed of for example, a metal plate, such as a steel plate, and is held while being sandwiched between the base 140 and the plate holding cylinder 170. The side surface (outer circumferential surface) of the base 140 is formed to be a cylindrical surface, a step is formed at a midway point on the side surface, and the diameter of the back side portion thereof is smaller than that of the near side portion. On the back side portion of the outer circumferential surface of the base 140, a male thread (not shown) is formed. The plate holding cylinder is a cylindrical member having the inner diameter which is substantially equal to the diameter of the back side portion of the outer circumferential surface of the base 140, and a female thread (not shown) to be engaged with the male thread formed on the outer circumferential surface of the base 140 is formed on the inner surface of the plate holding cylinder 170. The fixing plate 150 has a circular hole having the diameter equal to the diameter of the back side portion of the outer circumferential surface of the base 140. When the base 140 is inserted into the circular hole of the fixing plate 150 to the back side, the step of the outer circumferential surface of the base 140 is hooked to the circular hole of the fixing plate 150. Then, by screwing the plate holding cylinder 170 to the outer circumferential surface of the case 140 on which the male thread is formed, the fixing plate 150 is fixed to the base 140 while being sandwiched between the step of the outer circumferential surface of the base 140 and the plate holding cylinder 170. By detaching the plate holding cylinder 170, it is possible to detach the fixing plate 150 from the base 140.

As shown in FIGS. 11 to 13, the pair of attachment holes 151 is formed in the fixing plate 150. When the tube pump 1 is attached to, for example, a frame of an apparatus (e.g., a washing machine) to which the tube pump 1 is to be installed, the fixing plate is fixed to the frame by inserting bolts into the attachment holes 151.

As described above, in this embodiment, the fixing plate 150 for fixing the tube pump 1 is detachable. Therefore, by using the fixing plate 150 having an appropriate shape for the frame to which the tube pump 1 is attached, it becomes possible to attach the tube pump 1 to various types of apparatuses.

The rotor 120 includes the rotor body 121, three rollers 122 and the rotor presser member 123. The three rollers 122 are rotatably supported around the axis thereof between the rotor body 121 and the rotor presser member 123. As shown in FIG. 13, at the central part of a ceiling 119 situated on the near side in the pump cassette 110, the rotor support shaft 114 is formed to extend to the back side. Engagement holes 121*a* and 123*a* into which the rotor support shall 114 is inserted are respectively formed in the rotor body 121 and the rotor presser member 123, and the rotor body 121 and the rotor presser member 123 are rotatably supported by the rotor support shaft 114.

As shown in FIGS. 12 to 14, the inner surface having the cylindrical surface shape is formed on the pump cassette 110, and the tube 160 is arranged along the inner surface 111 (specifically, the length direction is aligned along the circumferential direction of the inner surface 111). The tube 160 is pressed and flattened between the rollers 122 and the inner surface 111 of the pump cassette 110, and when the rotor 120 rotates around the rotor support shaft 114 of the pump cassette HO, the rollers 122 make the orbital motion along the inner surface 111 of the pump cassette 110 while pressing flattening the tube 160. As a result, the tube 160 produces the peristaltic motion, and the content of the tube 160 moves. For example, when the rotor 120 is rotated in the clockwise direction in FIG. 12, the content of the tube 160 is sent out from the first end 161 situated lower left portion in FIG. 12 to the second end 162 situated lower right portion in FIG. 12. As described above, by driving the rotor 120, the content of the tube 160 can be sent out.

As shown in FIGS. 14 and 15, at the lower side of the pump cassette 110, two flat plate parts 212 and 213 expanding in parallel with the paper face of FIG. 15 are formed. A pair of grooves 212*a* and 212*b* and a pair of grooves 213*a* and 213*b* extending from the back side end to the near side are respectively formed in the flat plate parts 212 and 213. The first end 161 and the second end 162 of the tube 160 are protruded from the operation chamber of the pump cassette 110 through the grooves 2112*a* and 213 and the grooves 212*b* and 213*b*, respectively. The width of each of the grooves 212*a*, 212*b*, 213*a* and 213*b* is set to be substantially equal to the outer diameter of the thickest one of the attachable tubes 160. The position of the bottom of each groove (the nearest side end), is set such that, even when the tube 160 is pressed to the bottom of the grove, the tube 160 is situated on the cylindrical surfaces of the rollers 122 (FIG. 13).

Figure 16:
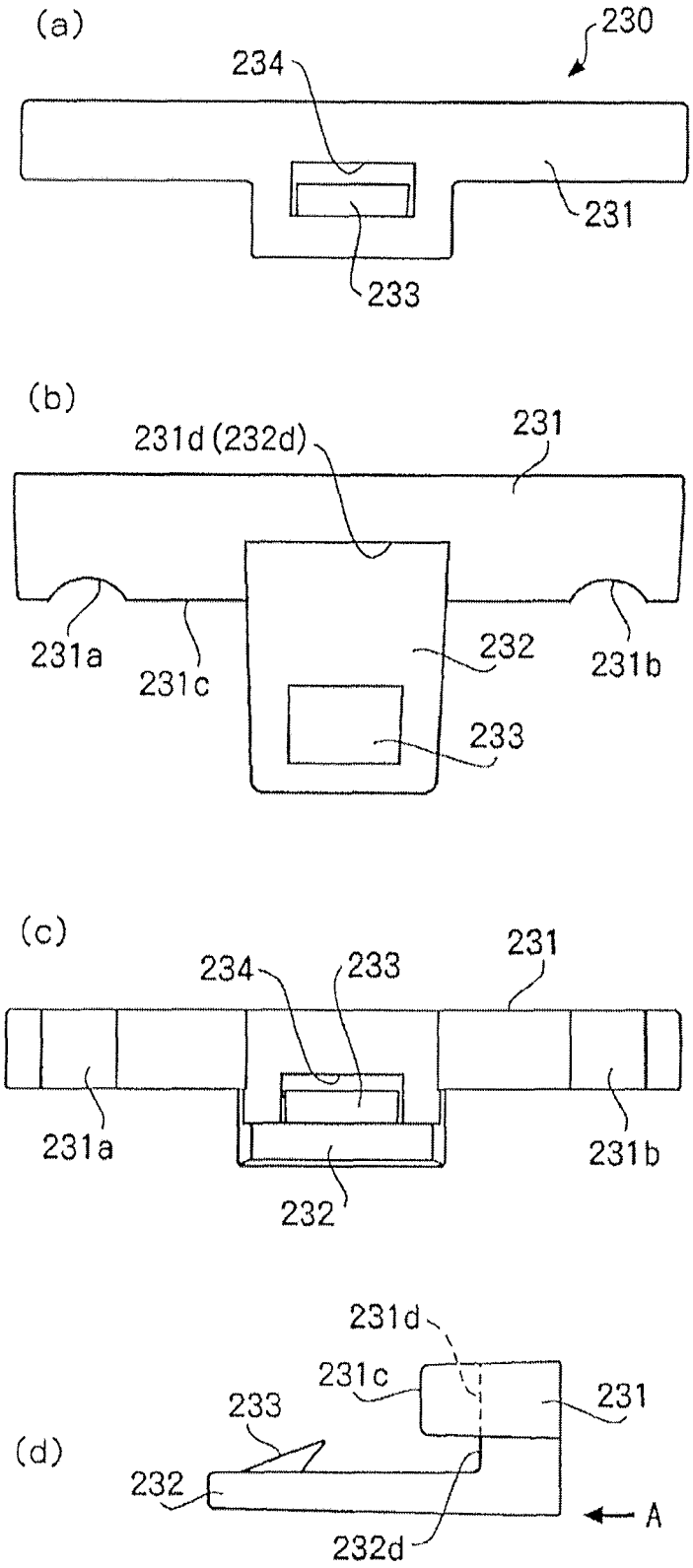
FIG. 16 is an outer appearance of a tube stabilizer according to the second embodiment, in which FIG. 16(*a*) is a rear view, FIG. 16(*b*) is a top view, FIG. 16(*c*) is a front view and FIG. 16(*d*) is a side view.

In a gap formed between the two flat plate parts, the tube stabilizer 230 (a holding part 231) according to the embodiment is inserted, and the tube 160 is sandwiched between the tube stabilizer 230 and the flat plate parts 212 and 213. As a result, the tube 160 is fixed and positioned. FIG. 16 illustrates an outer appearance of the tube stabilizer 230. FIG. 16(*a*) is a rear view, FIG. 16(*b*) is a top view. FIG. 16(*c*) is a front view, FIG. 16(*d*) is a side view. The tube stabilizer 230 is a member including the holding part 231 having a shape of a rectangular solid, and a hook 232 protruding from the lower surface of the holding part 231 to the near side, and has such flexibility that the tube stabilizer 230 can cause an engagement/disengagement operation. The tube stabilizer 230 according to the embodiment is formed of resin, such as PET (polyethylene terephthalate) or PP, by the injection molding. On the near side surfaces of the both ends of the holding part 231 in the width direction (the left and right direction in FIG. 16(*b*)), a pair of recessions 231*a* and 231*b* is formed. On the top surface near the tip of the hook 232, an engagement nail 233 is formed to protrude upward on the back side. The engagement nail 233 has a shape of a slander triangular prism extending in the width direction, and the tip thereof protruding upward on the back side is formed to have an acute angle. As shown in FIG. 16(*d*), the vertical cross section of the hook 232 is formed to have a shape of a letter "L", and a near side surface 232*d* (hereafter, referred to as an "offset surface 232*d*") of the short length part of the letter "L" is formed to have an offset to the back side with respect to the nearest side surface 231*c* of the holding part 231. In this embodiment, the offset surface 231 is extended to the holding part 231, and an offset surface 231*d* continuing from the offset surface 231*c* is formed. The offset surface 231 of the holding part 31 is provided for the purpose of serving to enhance the efficiency of the ejection molding and decreasing the use amount of resin, and the offset surface 231*d* is not necessarily required on the holding part 231. The opening 234 penetrating through the tube stabilizer 230 in the depth direction is provided for convenience of processing, and the opening 234 is not necessarily required depending on the processing method.

When the tube stabilizer 230 is attached to the pump cassette 110, the holding part 231 is inserted into the space between the flat plate parts 212 and 213. The thickness of the protruded part of the holding part 231 protruded to the near side from the offset surface 232*d* (the size in the vertical direction in FIG. 16(*d*)) is set to be substantially equal to the space between the flat plate parts 212 and 213, and is sandwiched by the flat plate parts 212 and 213 without a gap. The hook 232 of the tube stabilizer 230 is arranged under the flat plate part 212 to be along the flat plate part 212. The height of the offset surface 232*d* in FIG. 16(*d*) (i.e., the interval between the lower surface of the holding part 231 and the top surface of the hook 232) is set to be substantially equal to the thickness of the flat plate part 212, and the top surface of the hook 232 closely contacts the lower surface of the flat plate part 212. At a central portion on a lower edge of the front side portion of the pump cassette 110, an engagement projection 118*a* is formed, and the engagement nail 233 formed at the tip portion of the hook 232 of the tube stabilizer 230 is hooked to the engagement projection 118*a*, so that the tube stabilizer 230 is prevented from dropping off the pump cassette 110.

Figure 17:
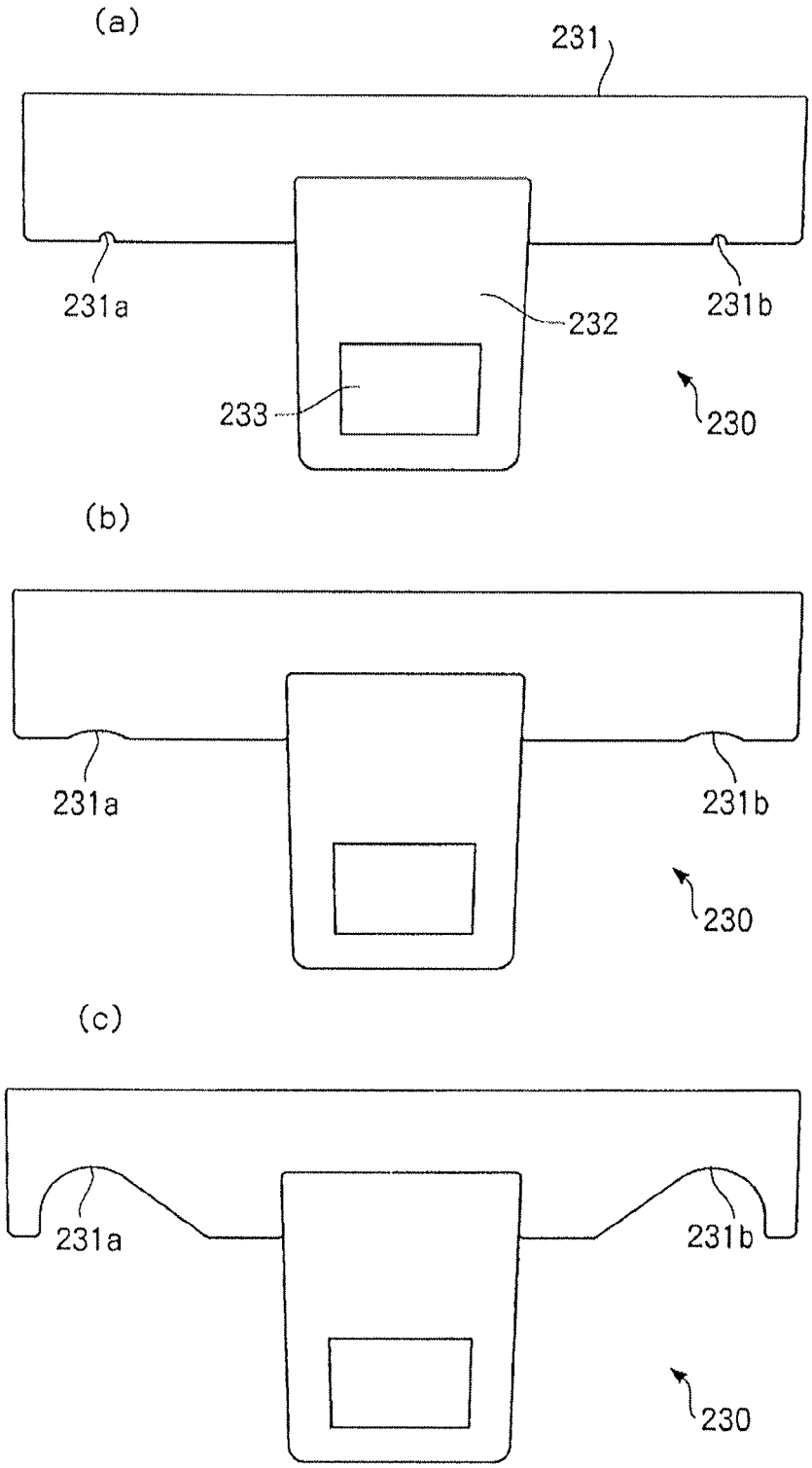
FIG. 17 shows top views of variations of the tube stabilizer according to the second embodiment.

The first end 161 of the tube 160 is sandwiched between the grove 212*a* of the flat plate part 212, the groove 213*a* of the flat plate part 213 and the recession 231*a* of the tube stabilizer 230, and is fixed so as not to move in the longitudinal direction the second end 162 of the tube 160 is sandwiched between the groove 212*b* of the flat plate part 212, the groove 213*b* of the flat plate part 213 and the recession 231*b* of the tube stabilizer 230, and is fixed so as not to move in the longitudinal direction. A force for holding the tube 160 between the pump cassette 110 and the tube stabilizer 230 (i.e., a deforming amount of the lube) is determined in accordance with the depth of the grooves 212*a*, 212*b*, 213*a* and 213*b* of the pump cassette 110, the depth of the recessions 231*a* and 231*b* of the tube stabilizer 230, and the offset amount of the offset surface 232*d* (the distance between the flat plane including the offset surface 232*d* and the plane including the foreground surface 231*c* of the holding part 231). Since these parameters are determined by the processing sizes of the pump cassette 110 and the tube stabilizer 230, as long as the same tube 160 is used, the tube 160 is held by a predetermined constant force. Therefore, the tube 160 is prevented from being excessively deformed, and the tube 160 is prevented from moving in the longitudinal direction due to an insufficient holding force. Furthermore, by setting the size and the shape of the recessions 231*a* and 231*b* depending on the size and the material (rigidity) of the tube 160, various types of tubes can be held by an appropriate holding force. Shape variations of the recessions 231*a* and 232*b* are illustrated in FIGS. 17(*a*) to 17(*c*). FIG. 17(*a*) illustrates an example of the tube stabilizer 230 adapted for the tube 160 having a small diameter, and the recessions 231*a* and 231*b* each having a semicircular shape with a small radius which is the same as that of the tube 160 are formed. FIG. 17(*b*) illustrates an example of the tube stabilizer 230 adapted for the relatively rigid tube 160 having a large diameter, and each of the recessions 231*a* and 231*b* is formed such that the depth thereof is small so that the contacting area with the tube becomes small. With this configuration, it is possible to hold the tube with a strong force. FIG. 17(*c*) illustrates an example in which each of the recessions 231*a* and 231*b* is formed to be deep and further the frontage is broadened. With this configuration, the tube 160 can be easily guided to the recessions 231*a* and 231*b* and the grooves 212*a*, 212*b*, 213*a* and 231*b* of the pump cassette 110 when the tube is fixed by the tube stabilizer 230.

The pump cassette 110 accommodates the tube 160 and the rotor 120, and is fixed to the base 140 in the state where the tube 160 is fixed to the pump cassette 110 by the tube stabilizer 230. By fixing in advance the tube 160 to the lower edge of the pump cassette 110 by the tube stabilizer 230, handling of the tube 160 can be eased when the pump cassette 110 is fixed to the caser 140.

When the pump cassette 110 has been fixed to the case 140, the rotor 120 is sandwiched and held between the pump cassette 110 and the base 140. Furthermore, the output shaft 30 of the gear box 20 is coupled to the rotor 120, and the rotational drive by the output shaft 30 becomes available.

Next, an attaching and detaching method for the tube stabilizer 230 according to the embodiment is explained. As described above, the tube stabilizer 230 is attached to the pump cassette 110 after the tube 160 and the rotor 120 are accommodated in the pump cassette 110. When the tube stabilizer 230 is attached, first the first end 161 of the tube 160 is inserted into the groove 212*a* of the flat plate part 212, the groove 213*a* of the flat plate part 213, and the second end 162 of the tube 160 is inserted into the groove 212*b* of the flat plate part 212 and the groove 213*b* of the flat plate part 213. Next, the holding part 231 of the tube stabilizer 230 is inserted into the gap between the flat plate part 231 and the flat plate part 213. Further, by pressing the lower part of the back surface of the hook 232 toward the near side (in the direction of an arrow A in FIG. 16(*d*)) (according to circumstances, by further lifting up the tip of the hook 232 while pressing the back surface of the hook 232 to the near side), the engagement nail 233 of the tube stabilizer 230 engages with the engagement projection 118*a* of the pump cassette 110, and thus the attachment is completed.

Figure 18:
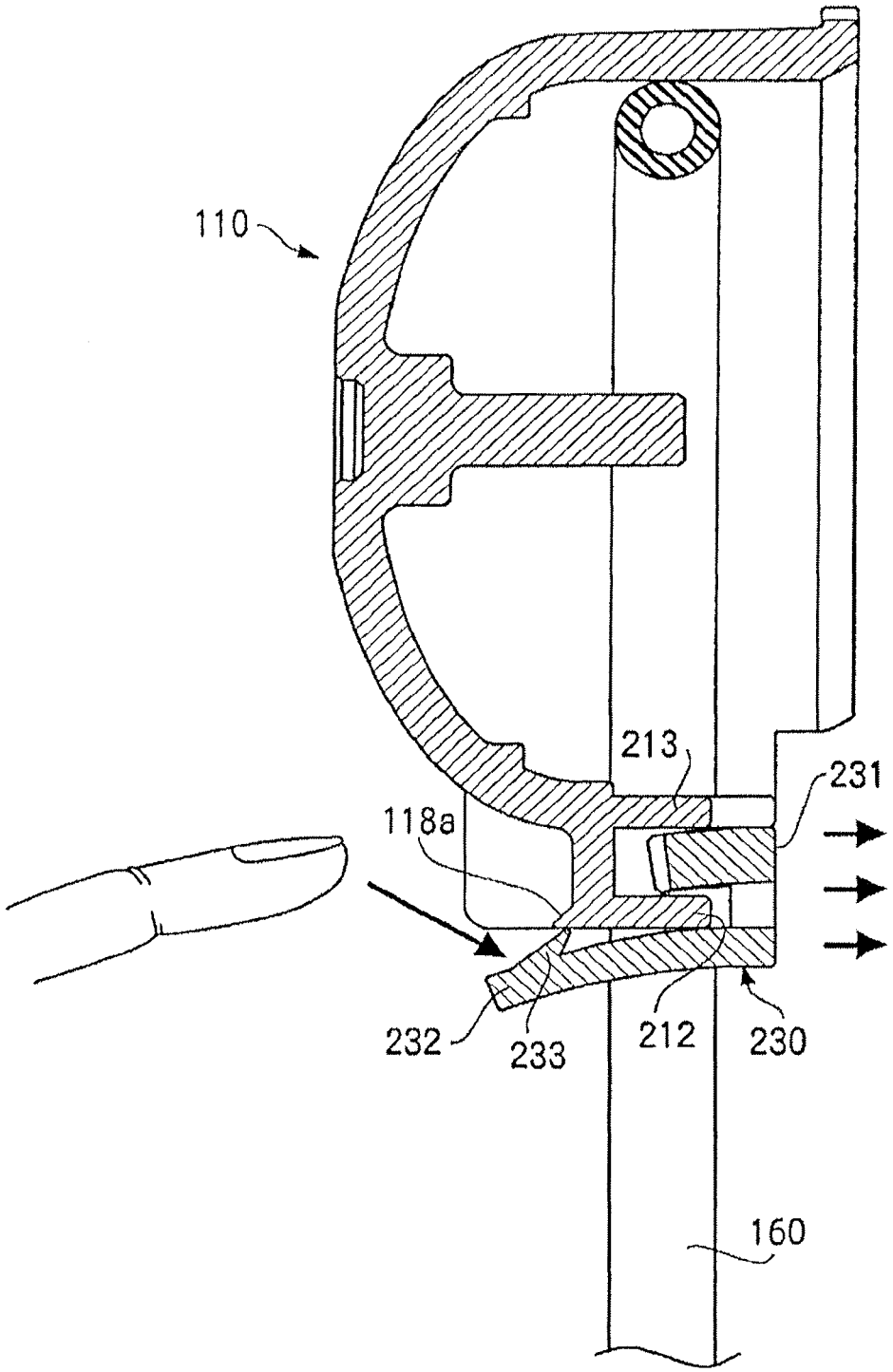
FIG. 18 is an explanatory illustration for explaining a detaching method of the tube stabilizer according to the second embodiment.

Next, detaching of the tube stabilizer 230 is explained. FIG. 18 is an explanatory illustration for explaining the detaching manner of the tube stabilizer 230. As shown in FIG. 18, by pressing down the tip of the hook 232, the engagement between the engagement nail 233 of the tube stabilizer 230 and the engagement projection 113*a* of the pump cassette 110 is released. By further pressing the tube stabilizer 230 to the back side in this state, the tube stabilizer 230 is detached. As described above, the tube stabilizer 230 according to the embodiment eases the maintenance work for the tube pump 1, such as replacement of the tube 160, because the tube stabilizer 230 can be detached through a one touch operation.

As described above, in the tube pump 1 according to the embodiment, the pump cartridge providing the pump function is formed by the pump cassette 110, the tube 160, the rotor 120 and the tube stabilizer 230, and the pump cartridge is detachable attachable to the drive part (the drive motor 10, the gear box 20 and the base 140). Furthermore, the tube 160 is fixed to the pump cartridge by the tube stabilizer 230. In such a configuration, since each of the ends 161 and 162 of the tube is positioned and fixed to the pump cassette 110, the need for the work for adjusting the position of the tube 160 is eliminated when the pump cartridge is attached to the drive part, and therefore the assembling and maintenance work for the tube pump 1 may be made more efficient. However, the configuration of the embodiment is not limited to such examples, a pump cartridge may be configured not to be detachable attachable to the rive part, and the tube may be fixed to the drive part (e.g., the base 140) by the tube stabilizer 230.

The forging is exemplary embodiments of the present invention. However, embodiments are not limited to the foregoing, and can be varied within the scope of the technical concept described in the claims. Hereafter, some variations of the embodiments according to the invention are shown. In the following variations, to elements which are the same as or correspond to those of the above described embodiments, the same or similar reference symbols are assigned.

In the above described embodiments, the tube 160 is held by sandwiching the tube 160 between the flat plate parts 212 and 213 (specifically the groves 212*a*, 212*b*, 213*a* and 213*b*) of the pump cassette 110 and the recessions 231*a* and 231*b* of the tube stabilizer 230. In this configuration, since the flat plate parts 212 and 213 and the holding part 231 are not on the same plane, a shearing force is applied to the tube. For this reason, when the thin-walled tube made of soft resin is used, the tube may buckle. In such a case, a second holding part 235 which is arranged between the flat plate part 212 and 213 to face the holding part 231 and which holds the tube 160 between the second holding part 235 and the holding part 231 may be provided.

Figure 19:
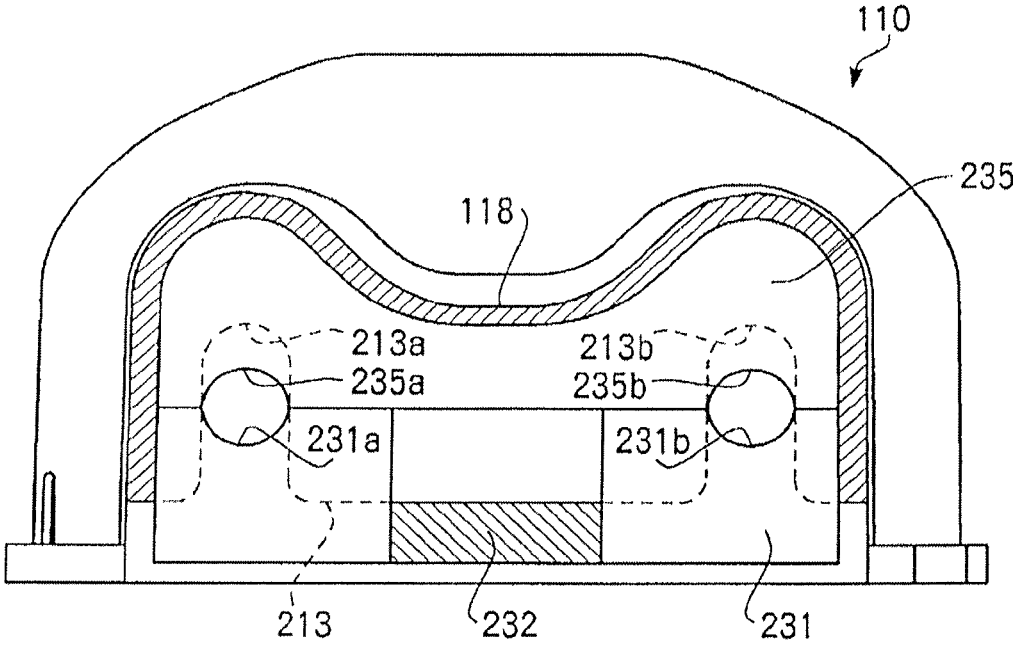
FIG. 19 illustrates a variation of the tube stabilizer according to the second embodiment.

FIG. 19 illustrates an example of the tube stabilizer 230 having the second holding part 235. FIG. 19 is a bottom view defined by cutting the pump cassette 110 to which the tube stabilizer 230 is attached by the top surface of the flat plate part 212. The second holding part 235 is arranged on the near side of the gap formed between the flat plate part 212 and the flat plate part 213 (the upper side in FIG. 19). Specifically, the second holding part 235 is used in the state where the second holding part 235 is sandwiched between the holding part 231 and the near side portion of a lower side wall 118 which connects the flat plate part 212 to the flat plate part 213. Recessions 235*a* and 235*b* are formed at the back side portion (the lower side in FIG. 19) of the second holding part 235. The shape and size of each of the recessions 235*a* and 235*b* is set appropriately in accordance with the material and the size of the used tube 160. In the example shown in FIG. 19, each of the recessions 235*a* and 235*b* is formed to be a semicircular shape having a diameter slightly smaller than the used tube. The first end 161 (not shown) of the tube 160 is held while being sandwiched between the recession 231*a* of the holding part 231 and the recession 235*a* of the second holding part 235. The second end 162 of the tube 1160 is held while being sandwiched between the recession 231*b* of the holding part 231 and the recession 235*b* of the second holding part 235.

In the example shown in FIG. 19, the end surface on the back side of the second holding part 235 is formed to be a flat shape, and is formed to contact the end surface on the near side of the holding part 231. Therefore, the force for holding the tube 160 (the deforming amount of the tube 160) is determined in accordance with the shapes and the sizes of the recessions 231*a* and 231*b* of the holding part 231 and the recessions 235*a* and 235*b* of the second holding part 235. In another example, the near side end surface of the holding part 231 may not contact the end surface of the second holding part 235, and in this case a constant holding force determined in accordance with the size of the tube stabilizer 230 is applied to the tube 160. Therefore, as long as the material and the size of the tube 160 are not changed, it is possible to constantly apply a predetermined holding force to the tube 160 even if the tube stabilizer 230 is attached or detached.

In the example shown in FIG. 19, the positions of the tips of the recessions 235*a* and 235*b* of the second holding part 235 are situated on the back side with respect to the positions of the tips of the grooves 213*a* and 213*b* of the flat plate part 213 as indicated by a dashed line. The width and depth of the grooves 213*a* and 213*b* of the flat plate part 213*n* are formed to be large enough so that various types of tubes can be used. Therefore, regarding the positioning method in which the tube 160 is pushed to contact the tips of the grooves 213*a* and 213*b* in the above described embodiments, the tube cannot be necessarily positioned at the optimum position. By providing the second holding part 235, a more appropriate positioning can be realized in accordance with the thickness and the material of the tube.

Figure 20:
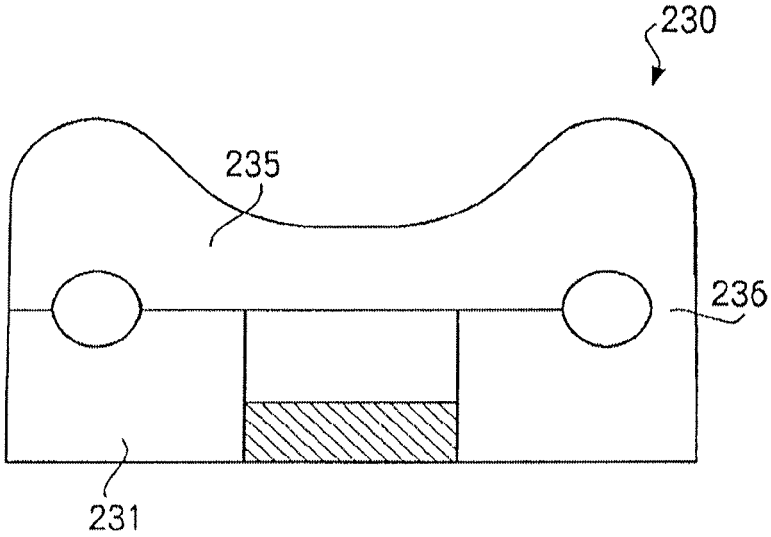
FIG. 20 illustrates a variation of the tube stabilizer according to the second embodiment.

Although, in the example shown in FIG. 19, the second holding member 235 is formed of one piece, the part for holding the first end 161 of the tube 160 (the part where the recession 235*a* is formed) and the part for holding the second end 162 of the tube 160 (the part where the recession 235*b* is formed) may be separate members. Although, in the example shown in FIG. 19, the near side end of the second holding part 235 is formed to be along the lower side wall 118 of the pump cassette 110, the shape of the near side end of the second holding part 235 is not limited to the shape shown in FIG. 19 as long as the second holding part 235 can be securely and stably positioned at an appropriate position. Although, in the example shown in FIG. 19, the holding part 231 and the second holding member 235 are provided as separate members, the holding part 231 and the second holding part 235 may be formed as an integrated member. For example, as shown in FIG. 20, the tube stabilizer 230 may be formed such that the first holding part 231 and the second holding part 235 are coupled via a joint part 236. In this case, the joint part 236 serves as a kind of hinge, and it is possible to attach the tube stabilizer 230 to the tube 160 while causing the first holding part 231 and the second holding part 235 to depart from each other around the joint part 236 serving as an axis.

In the above described embodiments, one engagement nail 233 of the tube stabilizer 230 and one engagement projection 118*a* of the pump cassette 110 are formed, respectively. However, the number, the position and the shape of each of the engagement nails 233 and the engagement projections 118*a* are not limited to those in the above described embodiments. a plurality of engagement nails and engagement projections 118*a* may be provided depending on the material, the size and the arrangement interval of the tube. The number of the engagement nail 233 and the engagement projection 118*a* may not be one-to-one relationship. For example, a plurality of short engagement nails 233 may engage with one long engagement projection 118*a*.

The tube pump 1 according to the above described embodiment is a rotational pump configured such that the liquid in the tube is transported, by arranging the tube along the cylindrical inner surface of the pump cassette, by moving the rollers to cause the orbital motion along the inner surface and thereby continuously pressing and flattening the tube. However, embodiments of the invention are not limited to such a configuration. For example, the tube pump may be a linear type pump in which a tube is arranged on a slender flat plate and a roller moves straight along the flat plate.

In the tube pump 1 according to the above described embodiment, the two parallel flat plate parts 212 and 213 are formed, and the holding part 231 of the tube stabilizer 230 is inserted into the space between the two flat plate parts 212 and 213. However, embodiments of the invention are not limited to such a configuration. For example, when the second holding part 235 is not used, the tube 160 can be fixed by only one of the flat plate parts sandwiched between the holding part 231 and the hook 232. In place of the flat plate parts, a rail or a projection for supporting the ends (e.g., both ends in the width direction) of the tube stabilizer 230 may be provided on the inner surface of the lower side wall 118.

As described above, by using the tube fixing member according to the embodiment of the invention, pulling-in of the flexible tube due to the movement of the roller can be effectively prevented.

What is claimed is:

1. A tube pump, comprising:

a cap having a cylindrical inner circumferential surface;

a tube arranged along the inner circumferential surface of the cap;

a rotor configured to have a roller, to hold the roller to be able to make an orbital motion along the inner circumferential surface of the cap, and to transport content of the tube by pressing the tube with the roller and thereby causing a peristaltic motion of the tube; and a base to which the cap is attached, wherein:

the rotor includes a disk part which holds the roller on a base side, and a roller presser member that holds the roller between the roller presser member and the disk part;

a main support shaft is formed at a central part of the disk part such that the main support shaft extends toward the roller presser member and a tip of the main support shaft contacts the roller presser member, a rotor support shaft is formed to extend from the cap towards the rotor; the rotor presser member is rotatably supported by the rotor support shaft; and a rib extending along the main support shaft, said rib having a tip in contact with the roller presser member, wherein:

the rib has a projection on an end face of the rib; and the roller presser member has a hole into which the projection of the rib is fitted.

2. A tube pump, comprising:

a cap having a cylindrical inner circumferential surface;

a tube arranged along the inner circumferential surface of the cap; a rotor configured to have a roller, to hold the roller to be able to make an orbital motion along the inner circumferential surface of the cap, and to transport content of the tube by pressing the tube with the roller and thereby causing a peristaltic motion of the tube;

a base to which the cap is attached;

a drive unit that is fixed to the base and rotates the rotor so that the roller makes the orbital motion; and a joint shaft that transmits a rotational motion of an output shaft of the drive unit to the rotor, wherein:

the rotor includes a disk part which holds the roller on a disk side, and a roller presser member that holds the roller between the roller presser member and the disk part;

a main support shaft is formed at a central part of the disk part such that the main support shaft extends toward the roller presser member and a tip of the main support shaft contacts the roller presser member;

a positioning shaft part having a non-circular cross section is formed on a rotor side end portion of the joint shaft;

an engagement shaft part that has a non-circular cross section and has a diameter larger than that of the positioning shaft part is formed on a drive unit side portion of the joint shaft with respect to the positioning shaft part, the positioning shaft and engagement shaft having different shaped non-circular cross sections;

a positioning hole that is capable of engaging with the positioning shaft part is formed in the main support shaft; and an engagement hole that is capable of engaging with the engagement shaft part is formed in the disk part.

* * * * *